US007954343B2

(12) United States Patent
Lonati et al.

(10) Patent No.: US 7,954,343 B2
(45) Date of Patent: Jun. 7, 2011

(54) METHOD AND APPARATUS FOR CLOSING A TUBULAR KNITTED ARTICLE AT ONE OF ITS AXIAL ENDS, AT THE END OF ITS PRODUCTION CYCLE ON A CIRCULAR KNITTING MACHINE FOR HOSIERY OR THE LIKE

(75) Inventors: Ettore Lonati, Botticino (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 12/867,382

(22) PCT Filed: Feb. 20, 2009

(86) PCT No.: PCT/EP2009/052039

§ 371 (c)(1), (2), (4) Date: Aug. 12, 2010

(87) PCT Pub. No.: WO2009/112346

PCT Pub. Date: Sep. 17, 2009

(65) Prior Publication Data

US 2010/0313607 A1 Dec. 16, 2010

(30) Foreign Application Priority Data

Mar. 10, 2008 (IT) ..... MI08A0397

(51) Int. Cl.
*D04B 9/56* (2006.01)

(52) U.S. Cl. ..... 66/148

(58) Field of Classification Search ..... 66/147, 66/148, 19, 31, 58, 48, 47, 149 S, 149 R
See application file for complete search history.

(56) References Cited

U.S. PATENT DOCUMENTS 5,924,309 A * 7/1999 Conti ..... 66/58
(Continued)

FOREIGN PATENT DOCUMENTS

EP 0 942 086 A2 9/1999
(Continued)

OTHER PUBLICATIONS

Interantional Search Report and Written Opinion related to PCT/EP2009/052039.

*Primary Examiner* — Danny Worrell
(74) *Attorney, Agent, or Firm* — Husch Blackwell LLP

(57) ABSTRACT

A method and an apparatus for closing a tubular knitted article at one of its axial ends, at the end of its production cycle on a circular knitting machine for hosiery or the like. The method consists in ending the production of an article at one of its axial ends. The article is then picked up from the machine and transferred to a handling device located in a sewing or looping station. The pick-up is performed by transferring individually the loops of the last row of knitting from the needles of the machine to spikes of the handling device, which has an annular body composed of two semiannular elements. The article is then turned, and one of the two semiannular elements is turned over with respect to the other one, so that the spikes of one semiannular element face, and are aligned with, the spikes of the other semiannular element. The loops of knitting arranged on the spikes of one semiannular element are transferred to the spikes of the other semiannular element so that each spike of the latter semiannular element supports a pair of loops of knitting.

22 Claims, 35 Drawing Sheets

U.S. PATENT DOCUMENTS

| | | | | |
|---|---|---|---|---|
| 6,155,081 | A * | 12/2000 | Frullini et al. | 66/58 |
| 6,164,091 | A | 12/2000 | Frullini et al. | |
| 6,389,849 | B1 * | 5/2002 | Conti | 66/148 |
| 6,698,250 | B2 * | 3/2004 | Lonati et al. | 66/149 S |
| 7,107,797 | B2 * | 9/2006 | Frullini et al. | 66/148 |
| 2003/0233852 | A1 | 12/2003 | Lonati et al. | |
| 2006/0144095 | A1 | 7/2006 | Frullini et al. | |

FOREIGN PATENT DOCUMENTS

| | | | |
|---|---|---|---|
| EP | 1 375 719 | A1 | 1/2004 |
| WO | WO 2004/035894 | A1 | 4/2004 |

* cited by examiner

METHOD AND APPARATUS FOR CLOSING A TUBULAR KNITTED ARTICLE AT ONE OF ITS AXIAL ENDS, AT THE END OF ITS PRODUCTION CYCLE ON A CIRCULAR KNITTING MACHINE FOR HOSIERY OR THE LIKE

TECHNICAL FIELD

The present invention relates to a method and to an apparatus for closing a tubular knitted article at one of its axial ends, at the end of its production cycle on a circular knitting machine for hosiery or the like.

BACKGROUND ART

As is known, tubular knitted articles, such as for example hosiery, are generally produced by means of circular hosiery knitting machines and are unloaded from the machine with both of their axial ends open.

In the case of hosiery items, after their unloading from the machine that is produced them, it is necessary to close the toe, an operation that is performed by means of sewing or looping machines.

Since this operation requires the use of additional machines and labor, which affects significantly the overall production costs of hosiery, different techniques have been proposed to automate the closing of the toe of hosiery items or, more generally, the closing of an axial end of tubular knitted articles produced with circular knitting machines for hosiery or the like.

The several techniques proposed up to now can be divided into two main categories: a first category, which comprises techniques based on performing the closure directly on the machine that produces the article, at the beginning or at the end of its production, and a second category, which comprises techniques based on performing closure in a specifically provided sewing or looping station, which is spaced from the machine for producing the article.

The first category suffers the drawback that it limits significantly the productivity of the machines, since the closing operation requires a certain time during which the machine cannot produce a new article.

The second category, to which for example the technique disclosed in EP 0942 086 belongs, is able to obviate this problem at least partially, since the productive potential of the machines is penalized only as regards the time required to remove the article from the machine that produced it, which is the time after which the machine can begin the production of a new article while the preceding article is subjected to sewing or looping.

However, the operations for transferring the article from the production machine to the looping station often require the use of complex apparatuses that must ensure extremely precise operation.

In the use of these apparatuses, it has been observed that the operation of picking up the article from the needles of the machine that produced it is particularly critical, since it affects significantly the overall transfer times of the article and is not always capable of ensuring the required precision.

DISCLOSURE OF THE INVENTION

The aim of the present invention is to solve the problems described above by devising a method and an apparatus for closing a tubular knitted article at one of its axial ends, at the end of its production cycle on a circular knitting machine for hosiery or the like, which do not penalize the productivity of the machine and ensure high precision and reliability.

Within this aim, an object of the invention is to provide a method and an apparatus capable of closing an axial end of a tubular article by sewing or looping in a time that is shorter than, or at most equal to, the time required by the machine to produce a new tubular article.

Another object of the invention is to provide an apparatus that can be installed on a wide range of circular knitting machines for hosiery or the like.

Another object of the invention is to provide an apparatus that is structurally simple, has a reduced space occupation and can be produced with competitive costs.

This aim, as well as these and other objects that will become better apparent hereinafter, are achieved by a method for closing a tubular knitted article at one of its axial ends, at the end of its production cycle on a circular knitting machine for hosiery or the like, comprising an initial step for producing the article up to the formation of the last row of knitting, at the axial end of the article that lies opposite the axial end at which knitting began, by retaining the loops of knitting of said last row of knitting in the head of the needles of the machine that formed them, characterized in that it comprises the following additional operating steps:

- a step for individually picking up the loops of knitting by means of pick-up members arranged against the region of the stem of each needle located proximate to the latch on the opposite side with respect to the head;
- a step for removing the article from the machine that produced it, retaining is each loop of knitting of the last formed row of knitting by means of said pick-up members;
- a step for positioning the article at a sewing or looping station;
- a step for the individual passage of the loops of knitting from said pick-up members to spikes of an annular handling device composed of two semiannular elements, one of which can be overturned with respect to the other about a diametrical axis;
- a step for turning the article retained by said handling device;
- a step for superimposing each of the loops of knitting of one half-row of knitting on a corresponding loop of knitting of the other half-row of said last row of knitting on a same spike of said handling device by means of the overturning, through an arc of substantially 180° about said diametrical axis, of one of said two semiannular elements of the handling device with respect to the other semiannular element;
- a step for sewing or looping the mutually superimposed pairs of loops of knitting;
- a step for disengaging the article from said handling device.

To perform the method according to the invention, it is preferable to use an apparatus for closing a tubular knitted article at one of its axial ends at the end of its production cycle on a circular knitting machine for hosiery or the like, comprising:

- a pick-up device, which is provided with an annular body that supports pick-up members that can engage the needles of the machine and are adapted to pick up individually the loops of knitting retained on said needles; said pick-up device being movable on command from a pick-up position, in which it is arranged with its body coaxially around the needle cylinder of the machine, to a release position, in which it is arranged with its body at a sewing or looping station that is spaced laterally with respect to the machine;

a handling device, which is arranged at said sewing or looping station and is provided with an annular body composed of two semiannular elements with spikes that are arranged along a cylindrical surface whose axis coincides with the axis of the body of the handling device and are oriented axially; one of said two semiannular elements being able to turn over with respect to the other semiannular element about a diametrical axis in order to arrange face to face and align individually its spikes with the spikes of the other semiannular element in order to allow the passage of the loops of knitting from the spikes of one semiannular element to the spikes of the other semiannular element of the body of the handling device;

a turner for tubular articles, which is arranged at said sewing or looping station and can be actuated in order to turn a tubular article that is retained, at one of its axial ends, by the spikes of said handling device;

a sewing or looping head, which is arranged at said looping station and is provided with sewing or looping members that interact with the spikes of a semiannular element of the body of said handling device in order to close the axial end of the article by joining the pairs of loops of knitting carried by a same spike of said semiannular element of the body of the handling device;

characterized in that said pick-up members can move radially with respect to the axis of the body of said pick-up device and, when said pick-up device is in said pick-up position, can each be engaged against the region of the stem of a needle of the machine, said region of the stem of the needle being located proximate to the latch on the opposite side with respect to the head; said pick-up members, when said pick-up device is in said release position, being each engageable with a spike of said handling device.

BRIEF DESCRIPTION OF THE DRAWINGS

Further characteristics and advantages of the invention will become better apparent from the description of a preferred but not exclusive embodiment of the is method according to the invention and of the apparatus for performing it, illustrated by way of non-limiting example in the accompanying drawings, wherein:

FIG. 19 is a schematic sectional view of FIG. 18, taken along a plane passing through line XIX-XIX with the pick-up device in a position raised above the knitting machine for hosiery or the like;

FIG. 21 is a view of the same detail of FIG. 19*a*, with the pick-up device lowered onto the knitting machine for hosiery or the like;

FIG. 27 is a schematic axial sectional view of the lower portion of the turner, tilted toward the knitting machine for hosiery or the like;

WAYS OF CARRYING OUT THE INVENTION

Figure 1:
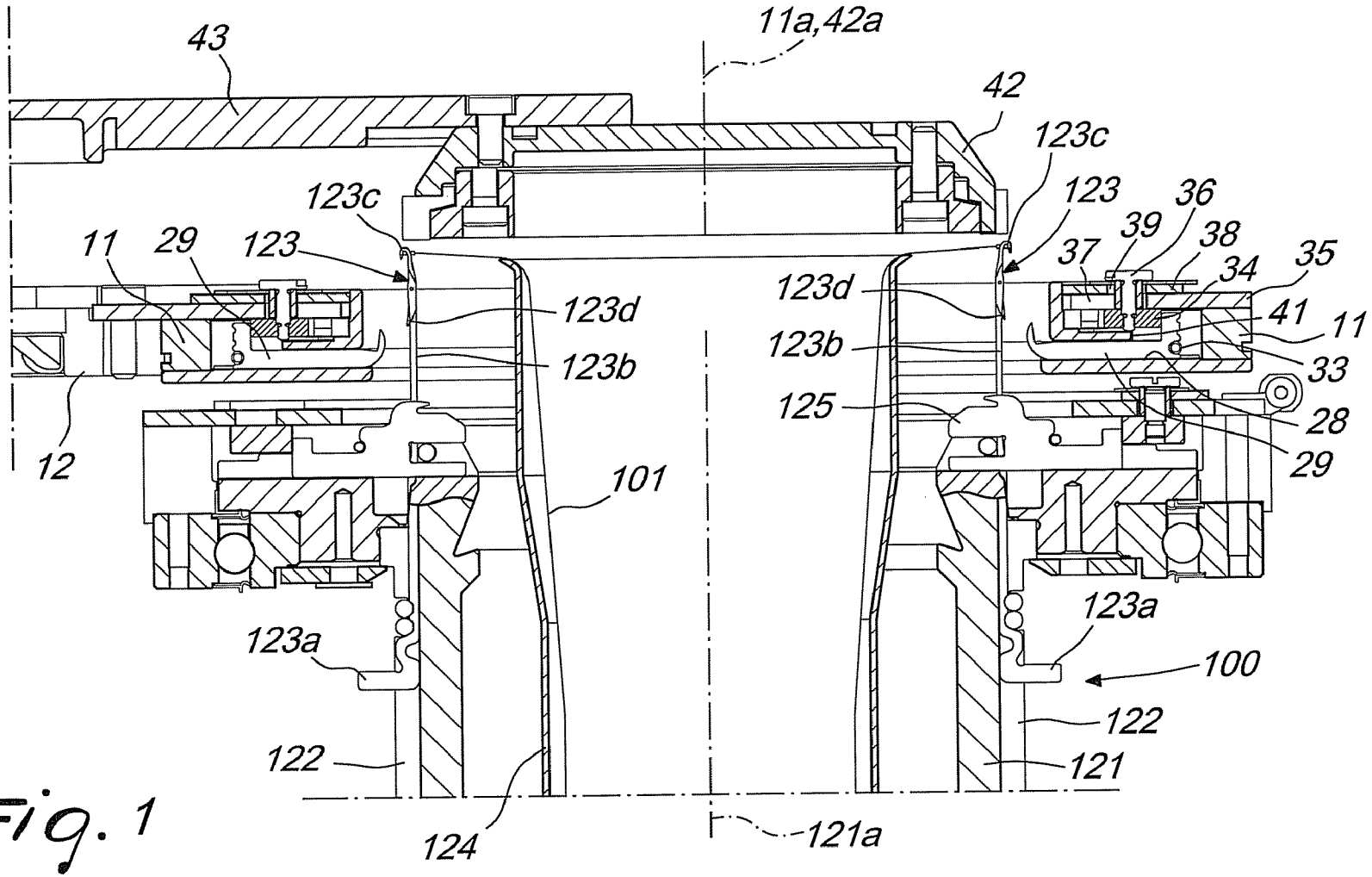
FIGS. 1 to 5 are schematic views of the steps for picking up and removing a tubular knitted article from the circular machine that produced it, in which the pick-up device and the machine are shown in axial cross-section and only partially.

With reference to the figures, the apparatus, generally designated by the reference numeral 1, in order to close a tubular knitted article at one of its axial ends, at the end of its production cycle on a circular knitting machine for hosiery or the like, comprises substantially: a pick-up device 10, which can move from the machine 100 that is used to produce the article 101 to a sewing or looping station 102, which is spaced laterally with respect to the machine 100, a handling is device 60, a turning device or turner 130 and a sewing or looping head 170, which are arranged at the sewing or looping station 102.

The circular knitting machine for hosiery or the like that is used to produce the article 101, generally designated by the reference numeral 100, is preferably constituted by a single-cylinder circular machine that has, in a per se known manner, a needle cylinder 121, whose axis 121*a* is oriented vertically. A plurality of axial slots 122 are formed on the lateral surface of the needle cylinder 121, and each one accommodates a needle 123 which can be actuated with a reciprocating motion along the corresponding axial slot 122 in order to form knitting.

Within the needle cylinder 121 there is, in a per se known manner, a suction tube 124, which is coaxial to the needle cylinder 121. This suction tube 124, whose upper end is open and goblet-shaped, can move along the axis 121*a* with respect to the needle cylinder 121, so as to be able to protrude, for part of its extension, from the upper end of the needle cylinder 121.

The needles 123 are actuated in a per se known manner, for example by means of cams, not shown for the sake of simplicity, which are arranged around the needle cylinder 121 and can engage, as consequence of the rotation of the needle cylinder 121 about its own axis 121*a*, with respect to said cams, the heels 123*a* of the needles 123 that protrude radially from the lateral surface of the needle cylinder 121. The machine 100, being a machine of a substantially known type, is not described further for the sake of simplicity.

The pick-up device 10, generally visible in FIGS. 18 to 22, comprises an annular body 11, which is arranged so that its axis 11*a* is vertical and is fixed to the end of an arm 12 that is arranged horizontally and is connected, by means of its opposite end, to a sleeve 13 that has a vertical axis 13*a*. The sleeve 13 is fitted coaxially about a hollow shaft 14 and is jointly connected thereto in rotation about its own axis 13*a*. The hollow shaft 14 is supported, so that it can rotate about the sleeve axis 13*a*, by a supporting structure 15, which can be constituted is by the supporting structure of the machine 100 proper or by an autonomous supporting structure that optionally can be associated with the supporting structure of the machine 100.

A gear 16 is keyed on the hollow shaft 14 and meshes with a gear 17 that is coaxial and jointly connected to a helical gear 18, which couples to a worm gear 19 that is fixed to the output shaft of an electric motor 20 supported by the supporting structure 15.

Substantially, the actuation of the electric motor 20 turns the arm 12 about the axis 13*a*, which constitutes a vertical actuation axis for the arm 12, with respect to the supporting structure 15, producing the transfer of the pick-up device 10 from a pick-up position, in which it is arranged with the body 11 coaxially to the needle cylinder 121 of the machine 100, to a release position, in which it is arranged with the body 11 at the sewing or looping station 102, and vice versa, as will become better apparent hereinafter.

Preferably, the rotation of the arm 12 can be stopped in a standby or intermediate position located between the pick-up position and the release position cited above.

The three positions that can be assumed by the pick-up device 10 as a consequence of the actuation of the electric motor 20 are controlled by three sensors 21, 22, 23, which detect references located on the block that supports the gear 17 and the helical gear 18.

The sleeve 13, with the arm 12 connected thereto, can move on command along the axis 13*a* with respect to the hollow shaft 14. More particularly, the sleeve 13 is jointly connected to a female thread 24, which has a vertical axis and with which a threaded shaft 25 mates which is connected, by means of a joint 26, to the output shaft of an electric motor 27 supported by a block that is fixed to the hollow shaft 14.

In this manner, an actuation of the electric motor 27 causes the lifting or is lowering of the arm 12 in any angular position of the arm 12 about the axis 13*a*.

The body 11 of the pick-up device 10 has a plurality of radial slots 28, within each of which a pick-up member 29 is accommodated so that it can slide.

Figure 23:
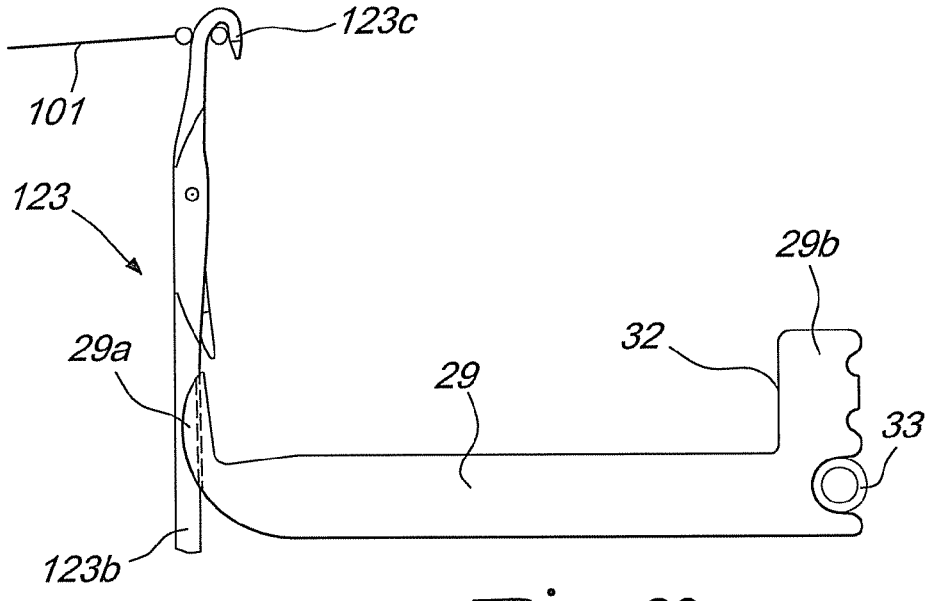
FIG. 23 is an enlarged-scale side elevation view of a pick-up member rested against the stem of a needle.
Figure 24:
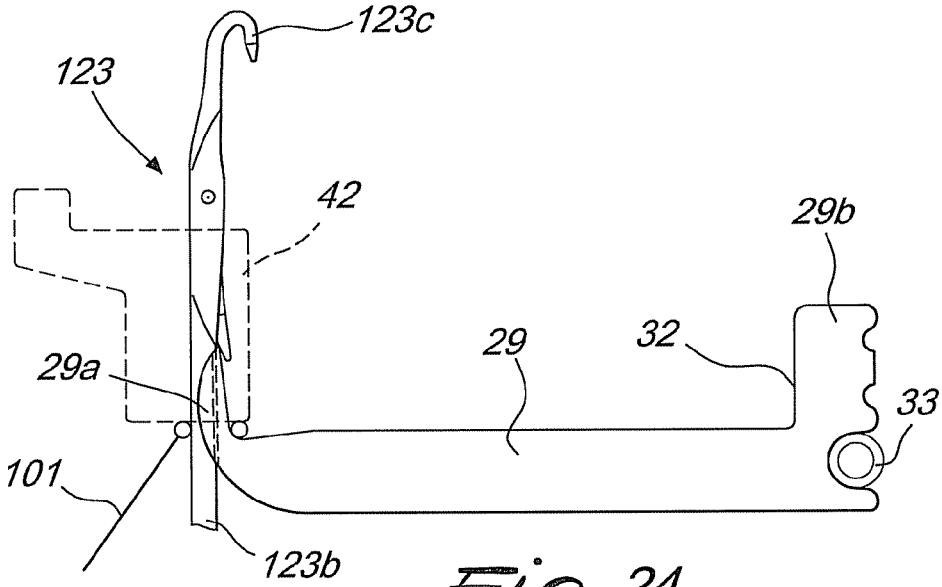
FIG. 24 is an enlarged-scale side elevation view of a pick-up member coupled to the stem of a needle during the passage of a loop of knitting from the needle to the pick-up member.
Figure 25:
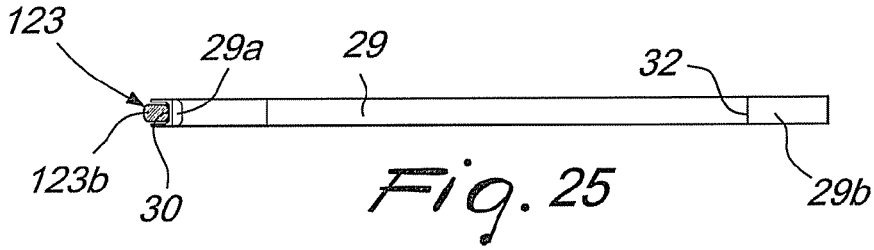
FIG. 25 is a top plan view of a pick-up member, mated with the stem of a needle, shown in transverse cross-section.

Each pick-up member 29, as shown in particular in FIGS. 23 to 25, has a laminar body arranged on a plane that is radial with respect to the axis 11*a* of the body 11. The end 29*a* of each pick-up member 29 that is directed toward the axis 11*a* has a seat 30 that is open both toward the axis 11*a* and parallel to said axis 11*a*, i.e., both above and below. This seat 30, when the pick-up device 10 is in the pick-up position, can be mated with the stem 123*b* of a needle 123 that the pick-up member 29 faces.

More particularly, the body 11 of the pick-up device 10 carries a number of pick-up members 29 that matches the number of needles 123 of the machine 100, and said pick-up members 29 are angularly spaced about the axis 11*a* of the body 11 in a manner that corresponds to the angular spacing, about the axis 121*a* of the needle cylinder 121, that exists between the needles 123 of the machine 100. Moreover, the body 11, in a peripheral region, bears a centering pin 31, which has a vertical axis and which, by means of the lowering of the arm 12, which can be actuated by means of the electric motor 27, can be inserted in a corresponding centering seat provided in the supporting structure of the machine 100 laterally to the needle cylinder 121 and not shown for the sake of simplicity. The mating between the centering pin 31 and the corresponding centering seat ensures precise positioning of the body 11 and of the pick-up members 29 with respect to the needle cylinder 121 of the machine 100. Appropriately provided control to members, usually provided in modern circular knitting machines for hosiery or the like, allow precise angular positioning of the needle cylinder 121 about its own axis 121*a* with respect to the supporting structure of the machine and therefore allow to position each needle 123 of the machine in radial alignment with the seat 30 of a corresponding pick-up member 29 when required.

The centering pin 31 can be disengaged from the corresponding centering seat by lifting the arm 12 to allow the rotation of the arm 12 about the axis 13*a*.

Each pick-up member 29 rests, with one of its sides, on the bottom of a corresponding radial slot 28 and protrudes from it, toward the axis 11*a*, with its end 29*a* in which the seat 30 is defined. It should be noted that the seat 30 can be delimited laterally by two mutually opposite walls, as in the illustrated embodiment, but can also be delimited only on one side by a single wall.

In the illustrated embodiment, the end 29*a* of each pick-up member 29 is shaped like a hook that is open upwardly and the seat 30 is formed on the back of the hook.

The end 29*b* that lies opposite the end 29*a* of each pick-up member 29 is shaped like a heel, which extends parallel to the axis 11*a* and protrudes upwardly from the corresponding radial slot 28 of the body 11, so as to form a shoulder 32 that is directed toward the axis 11*a*. Elastic means act against the side of this heel that is directed away from the axis 11*a* and push the pick-up members 29 toward the axis 11*a*. Said elastic means are constituted by an annular helical spring 33, whose axis coincides with the axis 11*a* and which is arranged around the pick-up members 29.

Radial pushers 34 are arranged in the body 11 and act on command on the shoulder 32 so as to produce the sliding of the pick-up members 29 away from the axis 11*a* in contrast with the action of the helical spring 33.

More particularly, the body 11 is closed in an upward region by a fixed annular plate 35, which is arranged concentrically to the axis 11*a*. Inside the body 11 there are five radial pushers 34, which are shaped like annular sectors and face the shoulder 32 of the pick-up members 29. Each one of these radial pushers 34 is fixed to two pins 36, which are mutually spaced and oriented parallel to the axis 11*a*. These pins 36 cross slidingly first slots 37 formed in the fixed plate 35. The pairs of first slots 37 with which the pins of a same radial pusher 34 engage are mutually parallel and are oriented so as to allow the corresponding radial pusher 34 to move toward and away from the axis 11*a*. A movable plate 38 is arranged above the fixed plate 35, is likewise annular, is arranged concentrically to the axis 11*a* and is supported, so that it can rotate about the same axis 11*a*, by the body 11. This movable plate 38 is crossed by second slots 39, one for each pin 36, each of which is crossed slidingly by a pin 36. The second slots 39 are inclined with respect to the first slots 37 so that a rotation of the movable plate 38 about the axis 11*a* with respect to the body 11 and the fixed plate 35 causes a movement of the radial pushers 34 toward or away from the axis 11*a*.

The movable plate 38 is connected to the stem of the piston of a fluid-actuated double-acting cylinder 40, which is mounted on the arm 12 and can be actuated to turn the movable plate 38 about the axis 11*a* with respect to the body 11.

Figure 20:
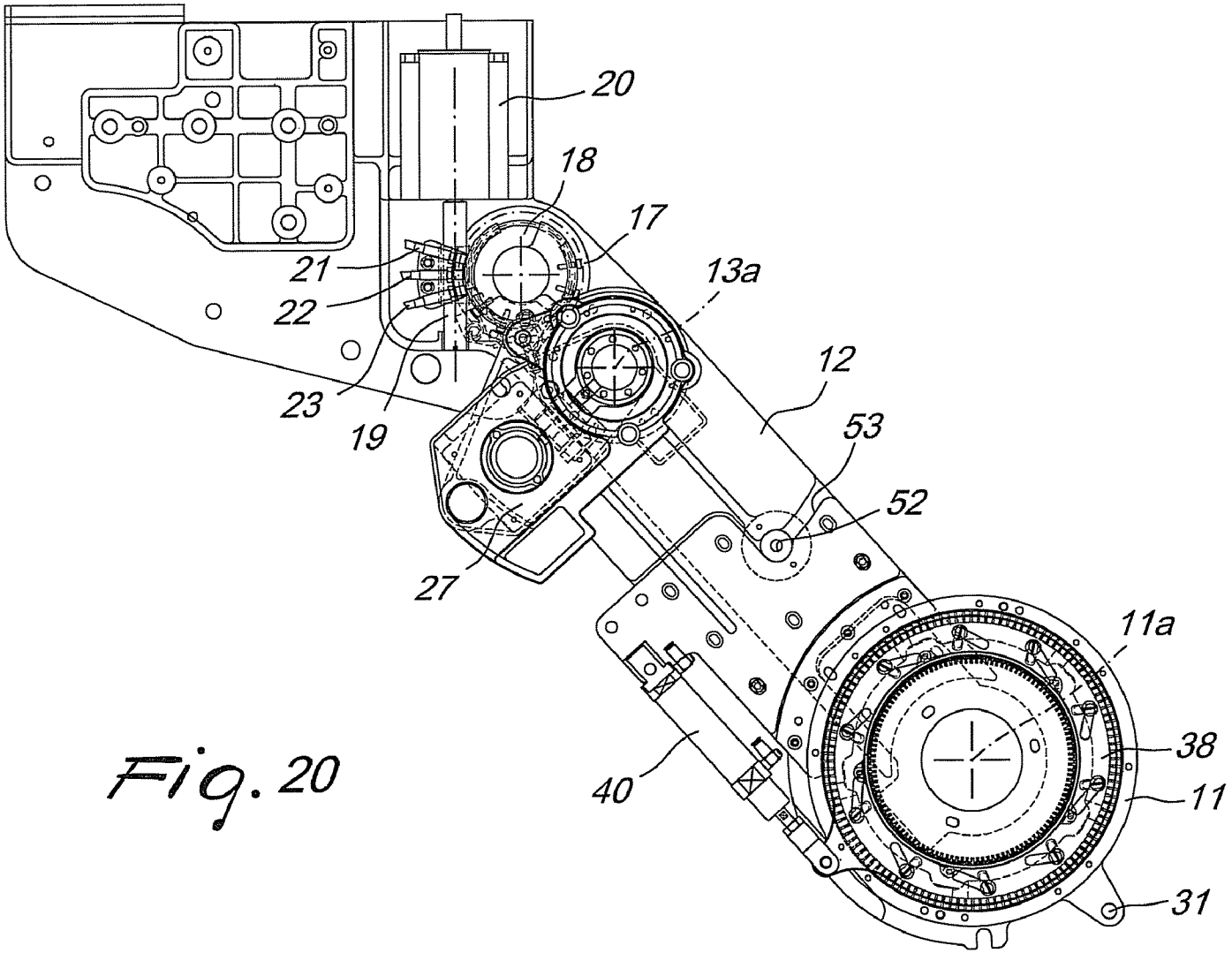
FIG. 20 is a schematic top plan view of the pick-up device in the position shown in FIG. 19.
Figure 20A:
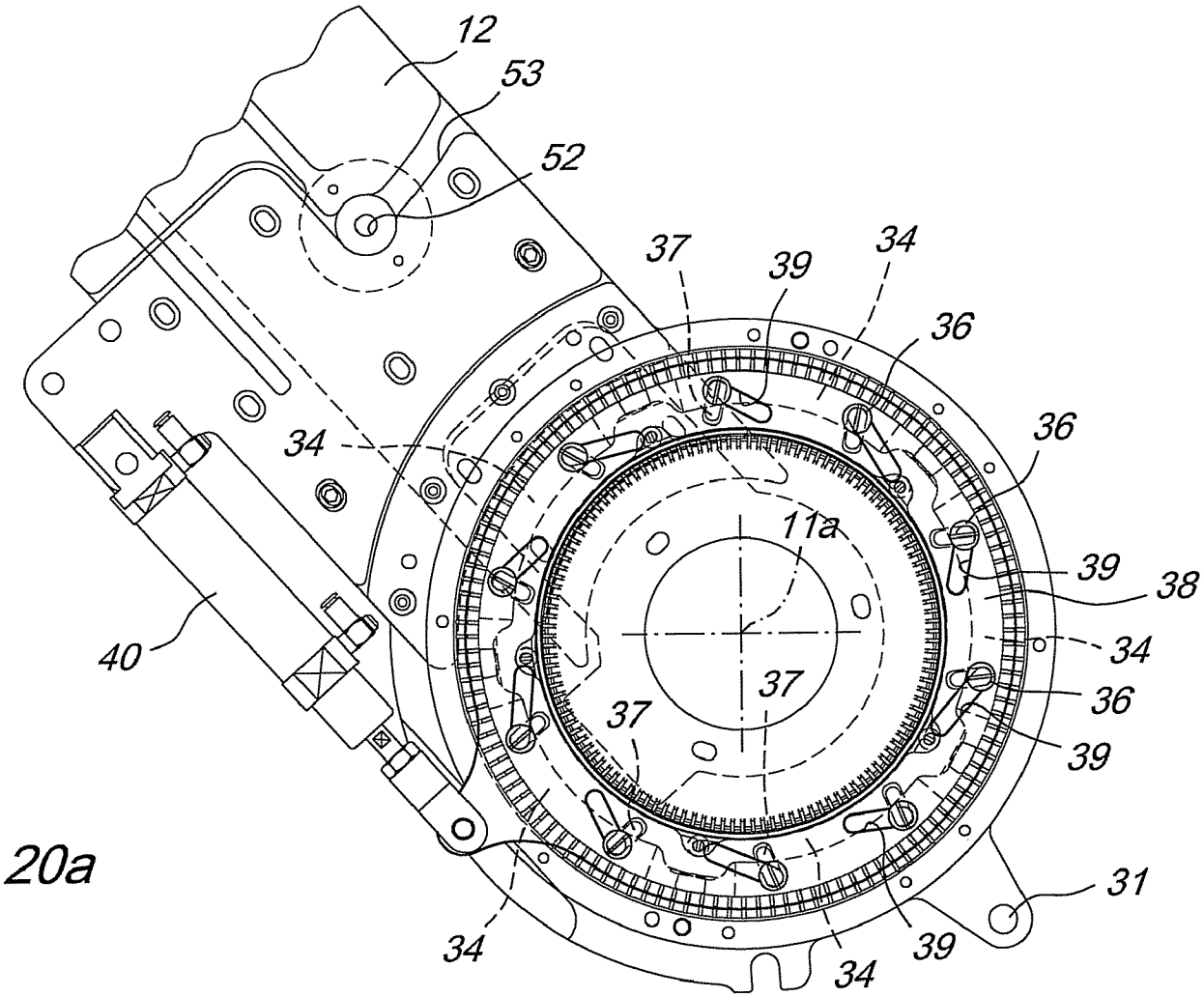
FIG. 20*a* is an enlarged-scale view of a detail of FIG. 20.
Figure 21:
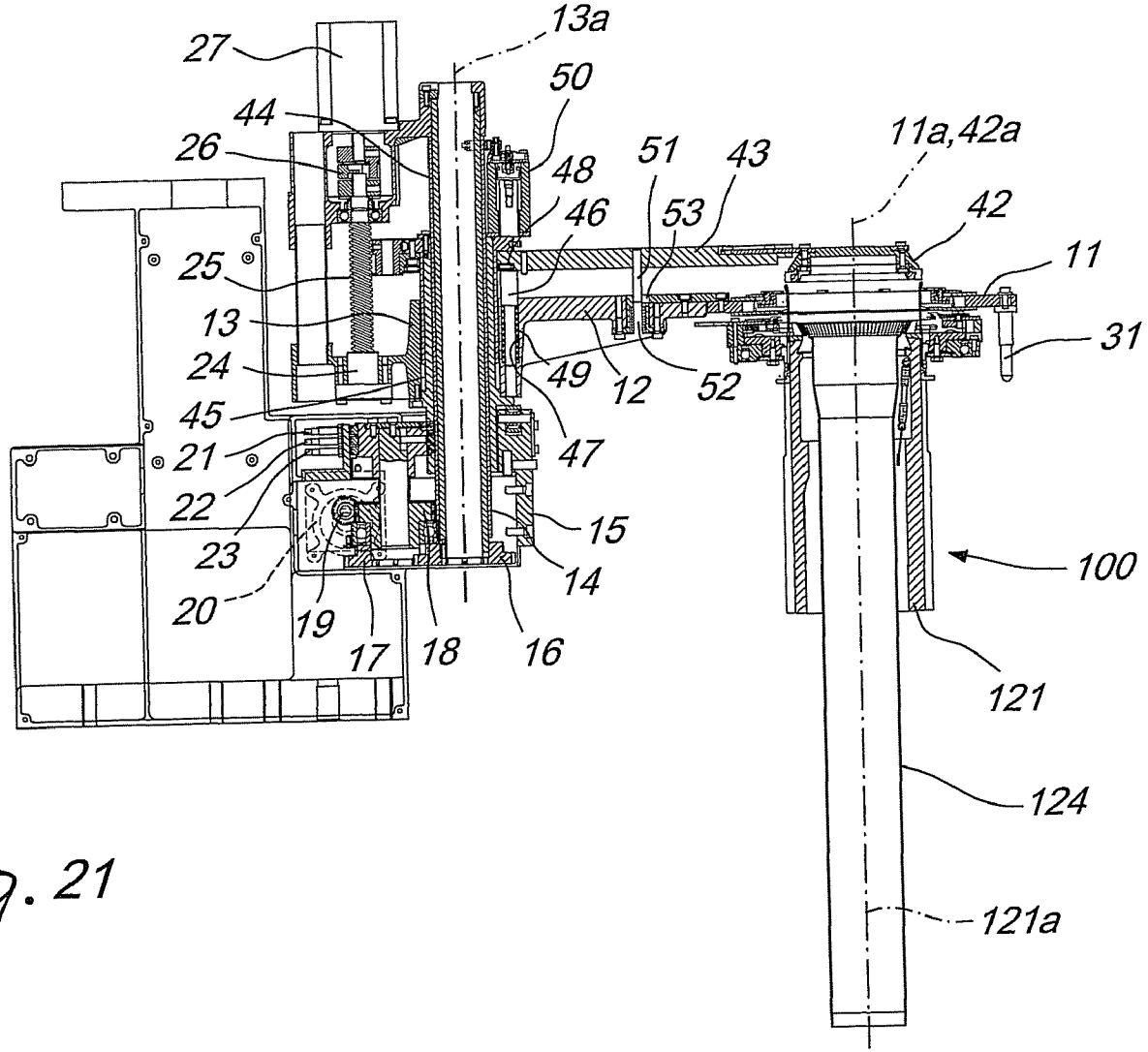
Figure 22:
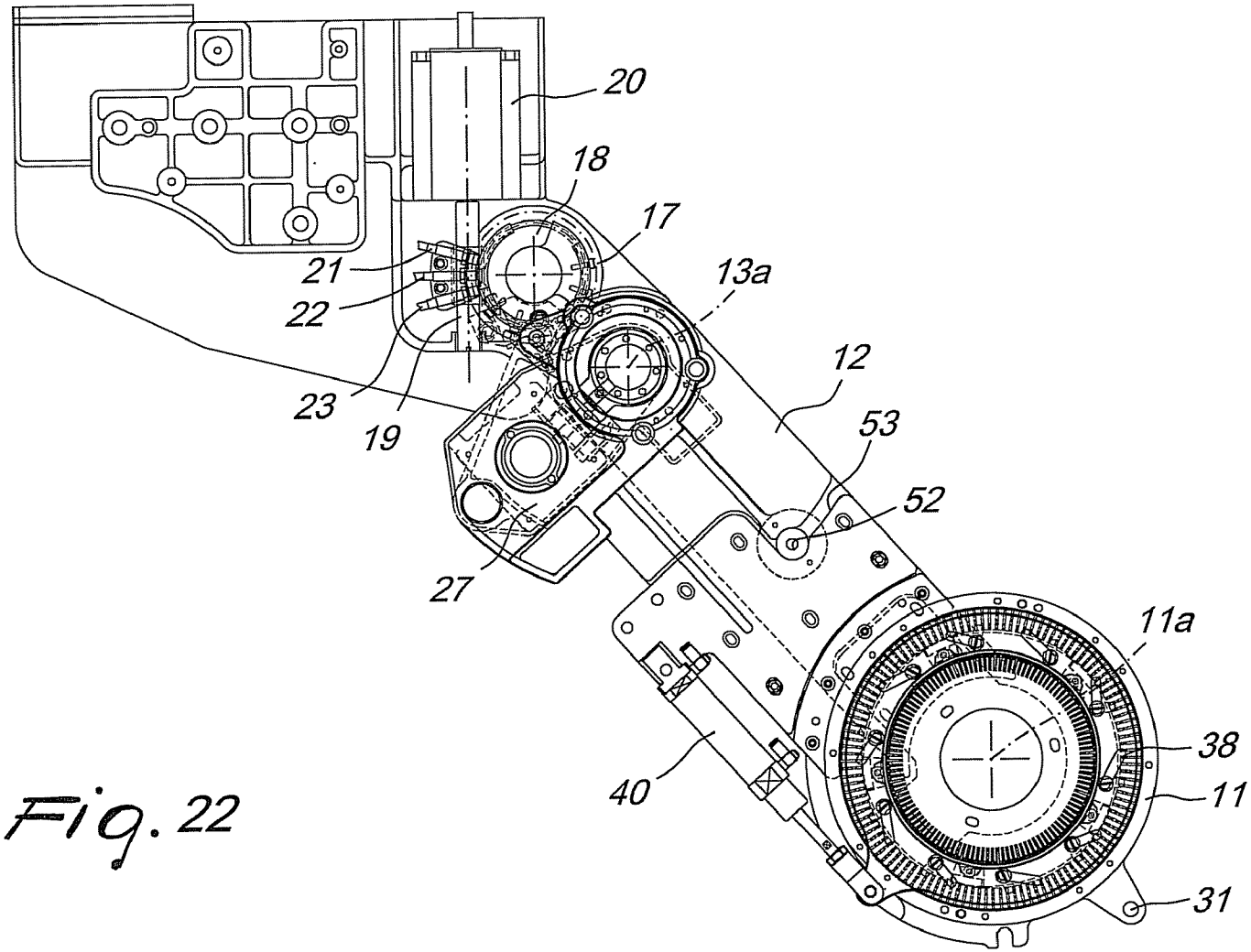
FIG. 22 is a schematic top plan view of the pick-up device in the position shown in FIG. 21.
Figure 22A:
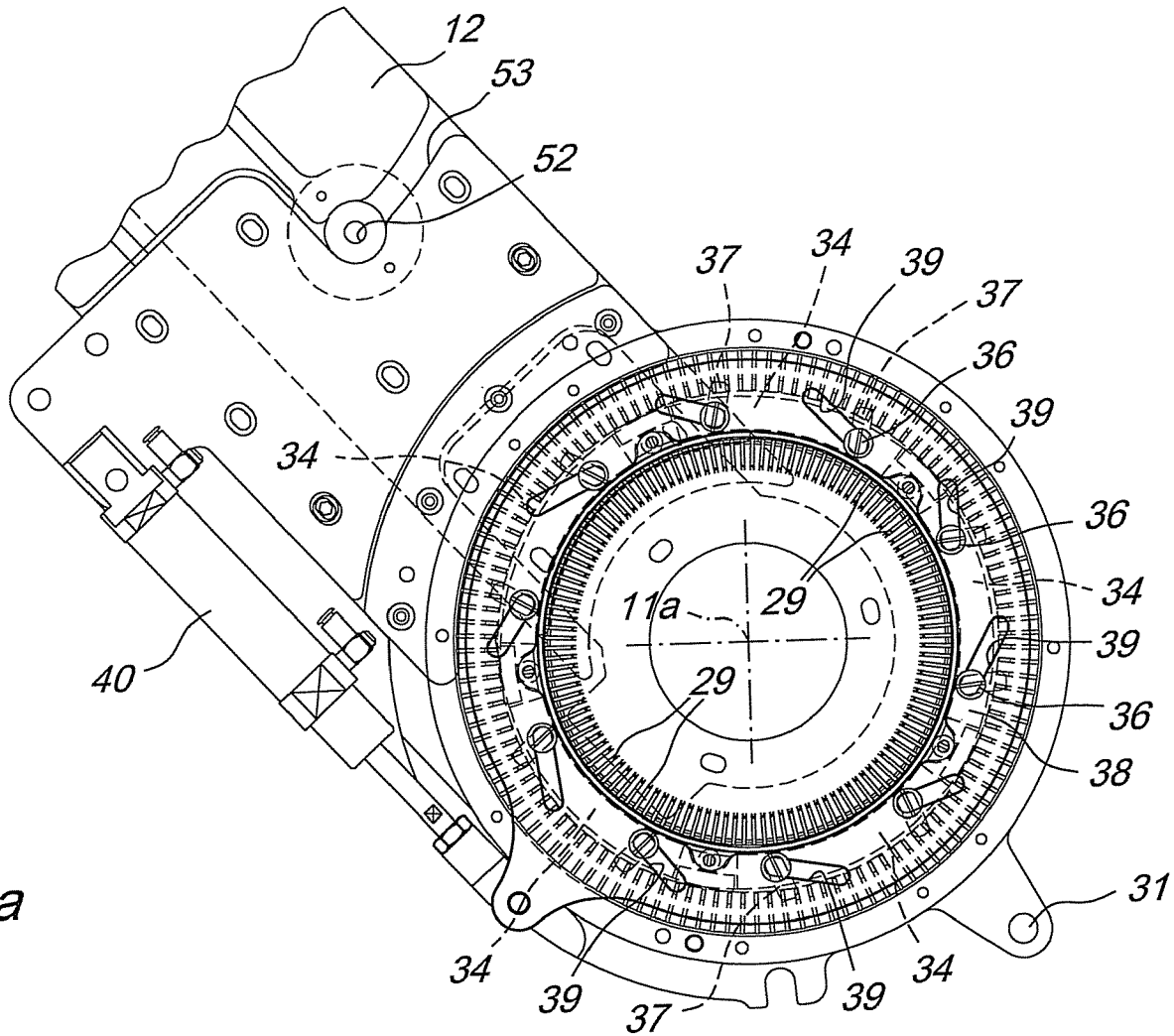
FIG. 22*a* is an enlarged-scale view of a detail of FIG. 22.

In practice, the actuation of the fluid-actuated cylinder 40 causes the rotation of the movable plate 38 about the axis 11*a* with respect to the body 11 in one direction, causing the spacing of the radial pushers 34 and therefore of the pick-up members 29 from the axis 11*a* in contrast with the action of the helical spring 33, as shown in particular in FIGS. 20, 20*a*, or in the opposite direction, actuating the approach of the radial pushers 34 to the axis 11*a*, allowing the movement of the pick-up members toward said axis 11*a* by way of the action of the helical spring 33, as shown in particular in FIGS. 22, 22*a*. The stroke of the pick-up members 29 toward the axis 11*a* is delimited by means for delimiting their stroke constituted by a shoulder 41 that lies opposite the shoulder 32 and is formed inside the body 11 or by the radial pushers 34 themselves.

It should be noted that each pick-up member 29 engages the stem 123*b* of the corresponding needle 123 by way of the action of the spring 33. As a consequence of this fact, a sort of adaptation of the stroke of each pick-up member 29 in the direction of the axis 11*a* to the actual radial position of the corresponding needle 123 is obtained. In practice, the particular actuation of the pick-up members 29 makes the mating of each pick-up member 29 with the corresponding needle 123 less critical, since it can obviate imprecise radial arrangements of the needles 123, ensuring in any case a precise mating. Moreover, the particular actuation of the pick-up members 29, in addition to allowing excellent containment of the axial space occupation of the pick-up device 10 as a whole, also allows to use a same pick-up device 10 with machines that have the same number of needles but in which the needles are arranged according to cylindrical surfaces that have slightly different diameters.

The pick-up device 10 also comprises a presser 42, which has a circular plan shape with a comb-shaped perimetric profile with a plurality of teeth arranged around the vertically oriented axis 42*a* of the presser 42.

The presser 42 is connected to an end of a corresponding arm 43, which in the illustrated embodiment is arranged above the arm 12. The arm 43 is connected, with its opposite end, to a corresponding sleeve 44, which is arranged coaxially to the sleeve 13 and is coupled, so as to allow rotation about the axis 13*a* and sliding along said axis 13*a*, in a cylindrical seat 45 that is formed in the sleeve 13.

The arm 43 rests on the upper end of columns 46 that have a vertical axis, are arranged around the axis 13*a* and are accommodated, so as to be able to slide axially, in corresponding seats 47 of the sleeve 13. The arm 43 rests on the columns 46 by means of a bearing 48, whose axis coincides with the axis 13*a*, so as to reduce the sliding of the arm 43 on the columns 46 during a rotation of the arm 43 with respect to the arm 12 about the axis 13*a*.

The columns 46 are pushed in the direction of the arm 43, and therefore upwardly in the illustrated embodiment, by springs 49 interposed between the columns 46 and the corresponding seats 47.

The sleeve 13 supports a fluid-actuated cylinder 50, which has a vertical axis and rests with the stem of its piston against the sleeve 44. In practice, the fluid-actuated cylinder 50 is jointly connected to the sleeve 13 for rotation about the axis 13*a* and for translational motion along said axis 13*a*, and can be actuated in order to produce the translational motion, downwardly in the illustrated embodiment, of the sleeve 44 and therefore of the arm 43 along the axis 13*a* with respect to the arm 12 in contrast with the action of the springs 49.

The arm 43, on its side directed toward the arm 12, is provided with a pin 51, which has a vertical axis and which, by means of the translational motion of the arm 43 with respect to the arm 12 along the axis 13*a*, can be inserted in a seat 52, which has a vertical axis and is formed in the arm 12, or can be extracted from said seat 52.

The mating of the pin 51 with the seat 52 ensures the coaxial arrangement of the presser 42 with respect to the body 11, and at the same time jointly connects to each other the arm 12 and the arm 43 and therefore the presser 42 and the body 11 for rotation about the axis 13*a*.

The inlet of the seat 52 is formed on the bottom and at a closed end of a slot 53 that is formed on the face of the arm 12 that is directed toward the arm 43. This slot 53 is shaped like a circular sector centered on the axis 13*a* and is open at an end thereof that lies opposite the end occupied by the seat 52. In the condition of maximum spacing of the arm 43 above the arm 12, the lower end of the pin 51 is at such a level as to disengage from the seat 52 but be able to engage the slot 53, as shown for example in FIGS. 19 and 19*a*. In this manner, in the condition of maximum spacing of the arm 43 above the arm 12, the arm 12 can rotate about the axis 13*a* with respect to the supporting structure 15, disengaging from the arm 43 in one direction, because the pin 51 protrudes from the open end of the slot 53, while in rotation in the opposite direction it engages the arm 43, because the pin 51 enters the same open end of the slot 53, engaging it, as will become better apparent hereinafter.

Figure 3:
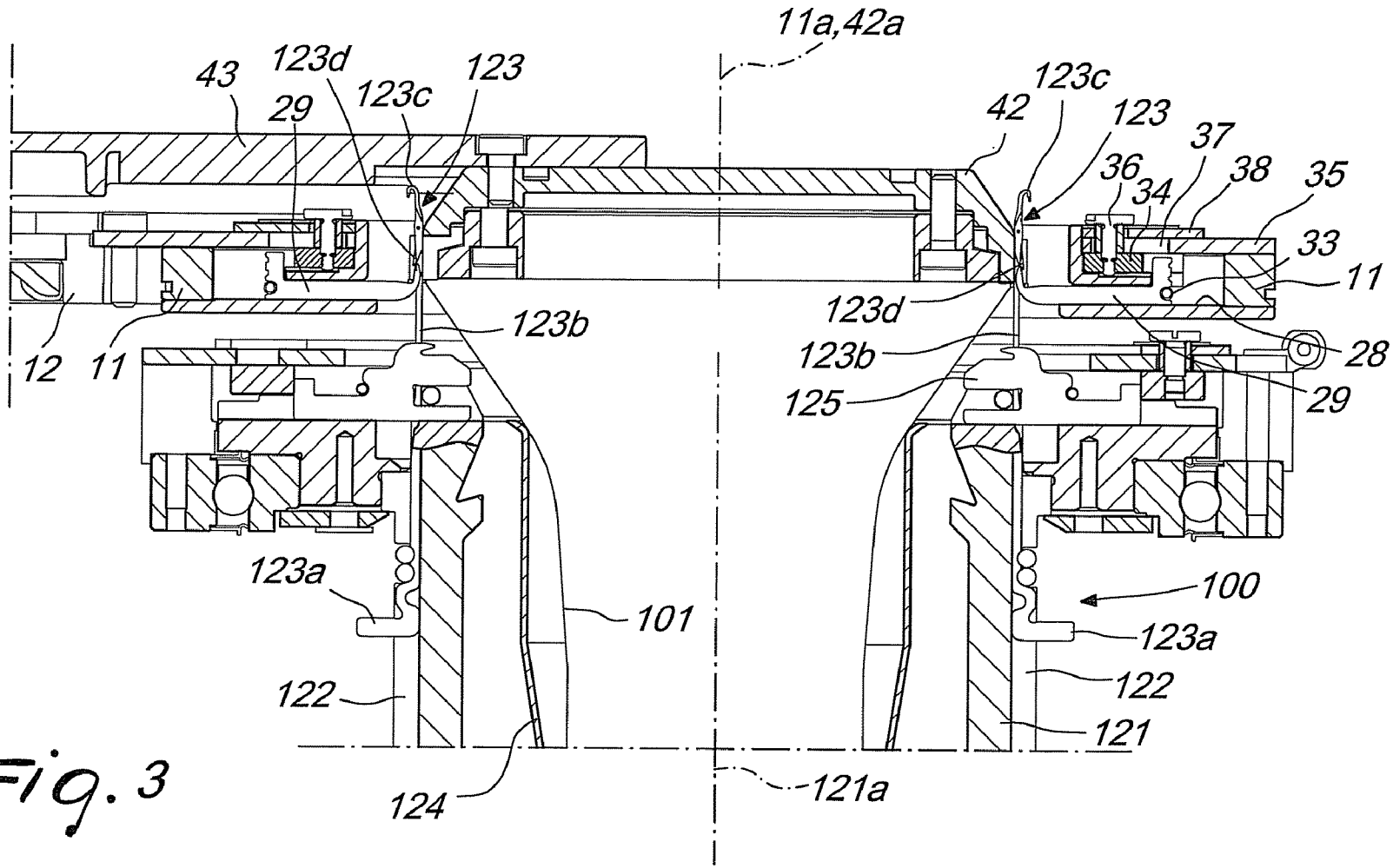
Figure 4:
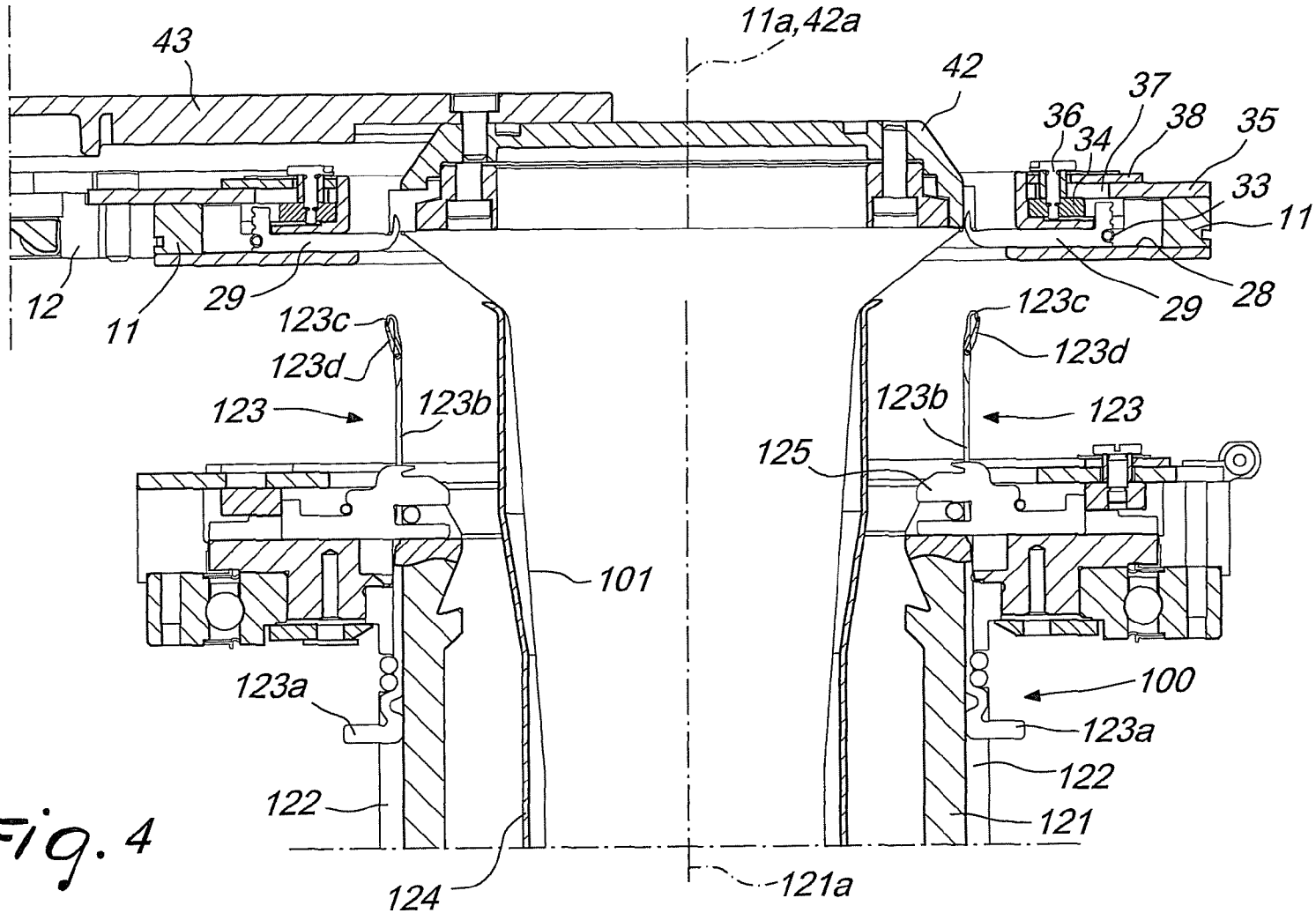
Figure 5:
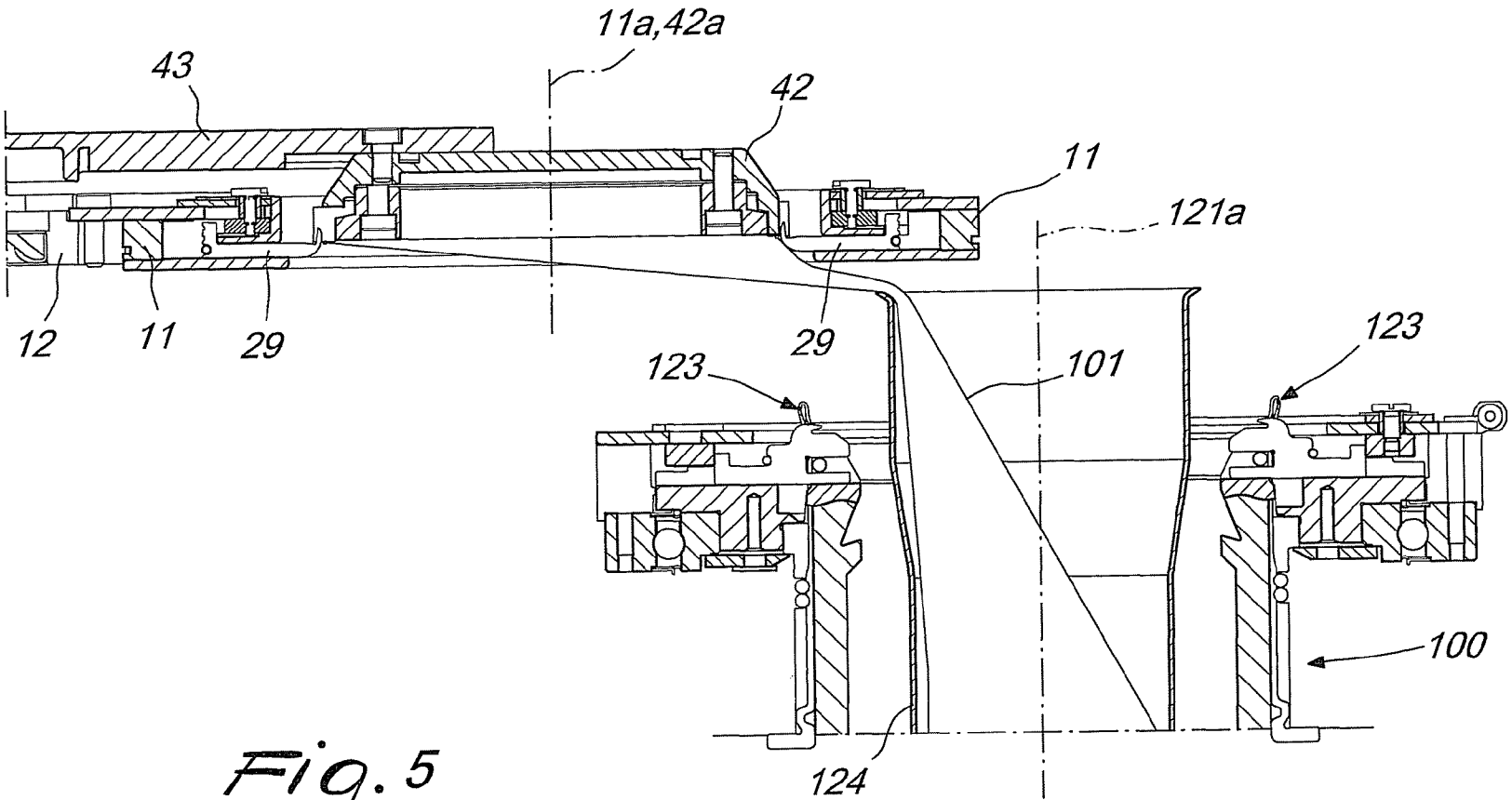
Figure 19:
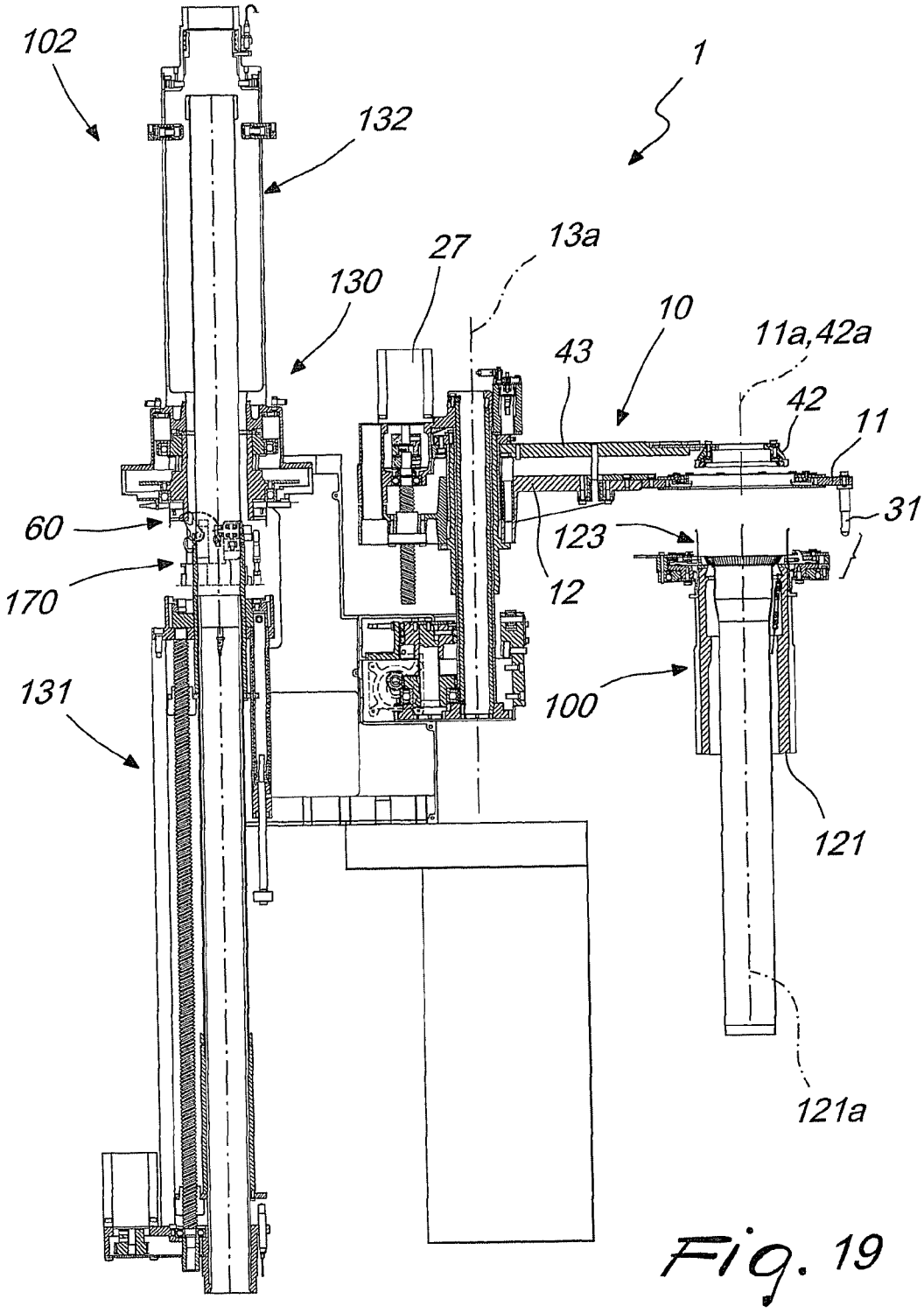
Figure 19A:
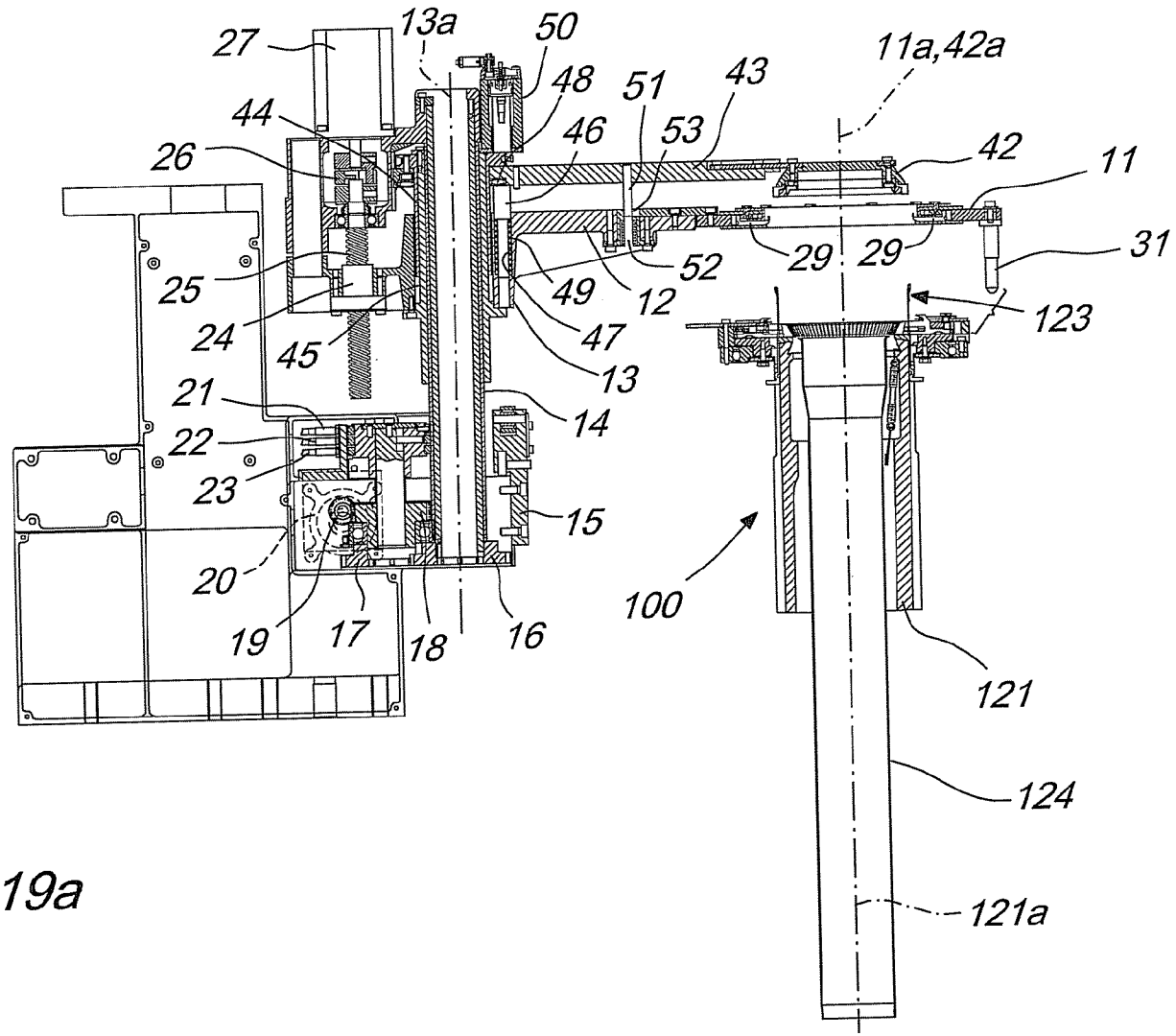
FIG. 19*a* is an enlarged-scale view of a detail of FIG. 19 related to the pick-up device.

The presser 42, particularly when it is in a position that is coaxial to the body 11, can move, by way of the actuation of the fluid-actuated cylinder 50, from a raised position, in which it is spaced upwardly from the body 11, as shown for example in FIGS. 19 and 19*a*, to a lowered position, in which it penetrates with the teeth of its perimetric profile between the pick-up members 29, as shown for example in FIGS. 3 to 5.

An abutment 54 is arranged along the path followed by the arm 43 in its rotation about the axis 13*a* and stops the rotation of the arm 43, in the raised position, in a position that corresponds substantially to the intermediate position of the arm 12 between the machine 100 and the sewing or looping station 102, preventing the arm 43 from following the arm 12 in the sewing or looping station 102. Vice versa, when the arm 12 rotates about the axis 13*a* from the sewing or looping station 102 to the machine 100 and reaches the intermediate position in which it had previously abandoned the arm 43, the pin 51 enters the slot 53 and, at the end thereof, i.e., when the pin 51 is coaxial to the seat 52, it entrains in its rotation toward the machine 100 the arm 43.

The handling device 60 is arranged at the sewing or looping station 102 and is provided with an annular body 61 that is arranged so that its axis or main axis 61*a* is vertical. The body 61 is provided, on its lower face, with a plurality of spikes 62, which are arranged along an imaginary cylindrical surface whose axis coincides with the axis 61*a* and extend parallel to said axis 61*a*. The spikes 62 are uniformly mutually angularly spaced around the axis 61*a*, with an angular spacing that corresponds to the spacing between the pick-up members 29 of the pick-up device 10. In practice, each pick-up member 29 is matched by a spike 62 of the handling device 60, and when the pick-up device 10 is arranged in the sewing or looping station 102 the body 11 of the pick-up device 10 is in a position that is coaxial to the body 61 of the handling device 60, with the pick-up members 29 arranged around the ring of spikes 62 and with each pick-up member 29 in radial alignment with a spike 62.

The seat 30, provided in the end of each pick-up member 29 that is directed toward the axis 11*a* and can be coupled to a needle of the machine 100, can be coupled likewise to a spike 62 by means of an axial movement of the body 11 and by means of a radial movement of the pick-up members 29 with respect to the spikes 62.

The body 61 is composed of two semiannular elements 63*a*, 63*b*, which are mutually pivoted about a diametrical axis 64. One of the two semiannular elements, constituted by the semiannular element 63*b*, can be turned over on command with respect to the other semiannular element 63*a* about the diametrical axis 64, so as to make each spike 62 of the semiannular element 63*b* face a corresponding spike 62 of the semiannular element 63*a*. Preferably, when the two semiannular elements 63*a*, 63*b* are in a coplanar position, the spikes 62 are directed with their tip downwardly and the semiannular element 63*b* can be turned over about the diametrical axis 64 so as to face in a downward region the semiannular element 63*a*.

More particularly, the body 61 is connected coaxially around a hollow cylinder 65, which has a vertical axis and is supported, so that it can rotate about its own axis, which coincides with the axis 61*a*, by a supporting structure 66, which can be part of the supporting structure 15 or an autonomous supporting structure. The semiannular element 63*a* is fixed to the outer lateral surface of the hollow cylinder 65, while the semiannular element 63*b* is hinged to the hollow cylinder 65 about the diametrical axis 64, as shown in particular in FIG. 31.

The hollow cylinder 65 is fixed coaxially to a gear 67, which meshes with another gear 68 fixed to the shaft of an electric motor 69 that is supported by the supporting structure 66. The actuation of the electric motor 69 causes the rotation of the hollow cylinder 65 about its own axis and therefore the rotation of the body 61 about said axis 61*a* with respect to the supporting structure 66.

Figure 31:
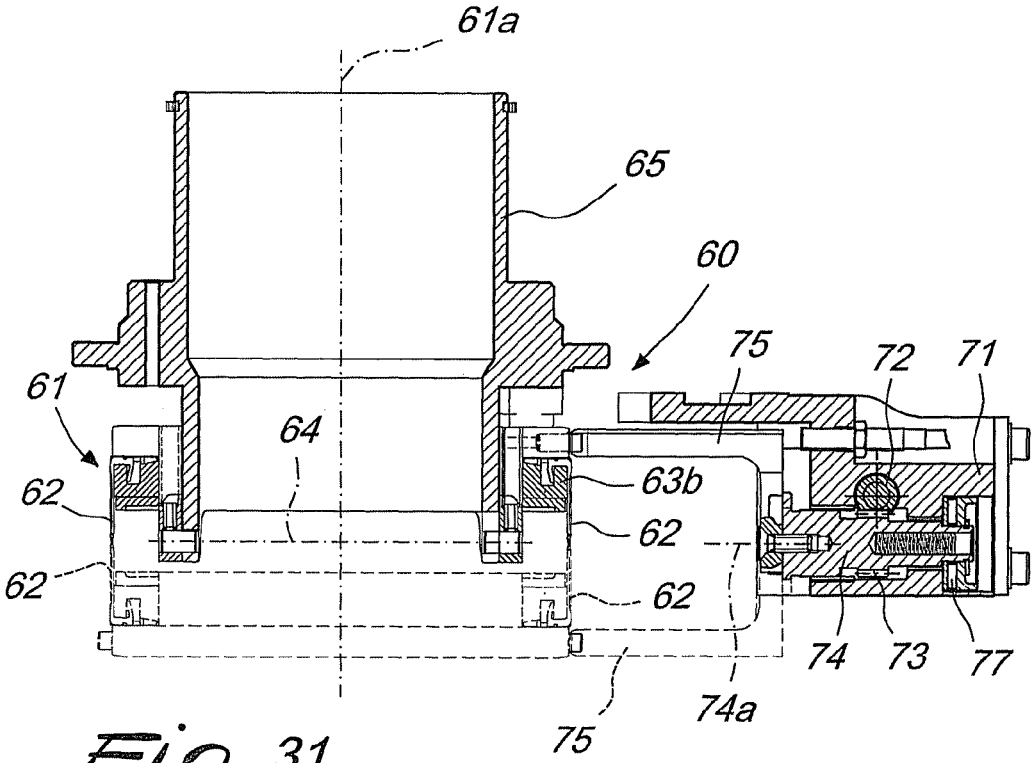
FIG. 31 is an axial sectional view of the handling device, taken along a vertical plane arranged at right angles to the sectional plane of FIG. 6.
Figure 32:
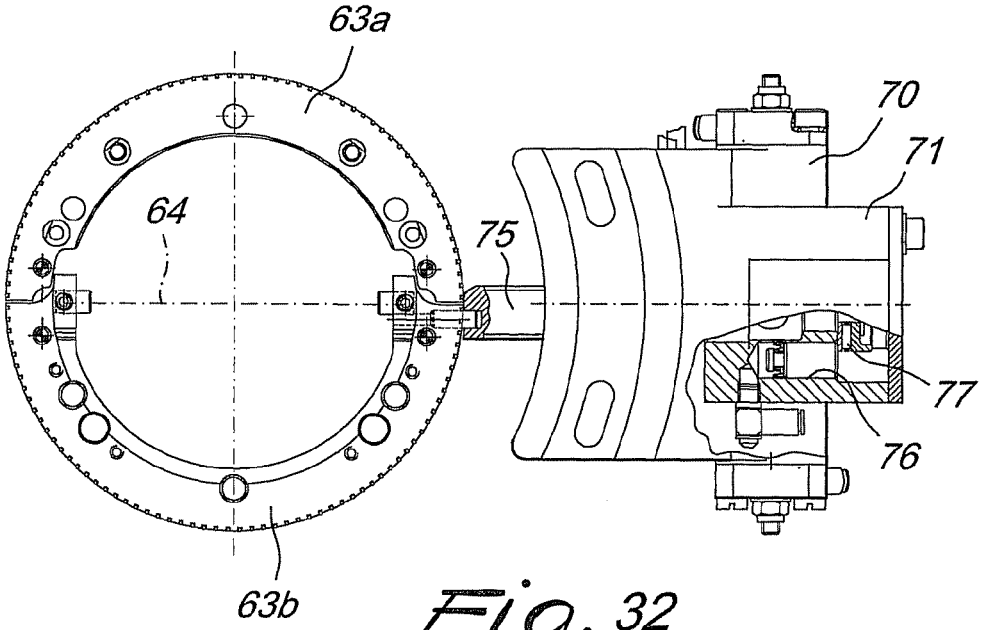
FIG. 32 is a top plan view of the handling device, with some elements omitted for the sake of simplicity and greater clarity.

The overturning of the semiannular element 63*b* about the diametrical axis 64, as shown in FIGS. 31 and 32, is actuated by means of a double-acting hydraulic cylinder 70, which is mounted on a block 71, which in turn is supported by a portion of the supporting structure 66. The hydraulic cylinder 70 is connected, by means of the stem of its piston, to a rack 72, which meshes with a toothed portion 73 that is jointly connected to a shaft 74, which can rotate with respect to the block 71 about its own axis 74*a*, which is oriented at right angles to the axis 61*a* of the body 61 and of the hollow cylinder 65. The shaft 74 is fixed to an arm 75, which has a portion that is parallel and spaced with respect to the axis 74*a* and can engage a portion of the semiannular element 63*b*. The actuation of the hydraulic cylinder 70 in either direction, by means of the rack 72 and the toothed portion 73, causes the rotation, in one direction or the other, of the shaft 74 and therefore the passage of the semiannular element 63*b* from the position in which it is coplanar with respect to the semiannular element 63*a* to the position in which it is turned over below it or vice versa.

Conveniently, the shaft 74 can move on command along its own axis 74*a* with respect to the block 71 by way of the action of a fluid-actuated cylinder 76, which is mounted on the block 71 and acts with its piston on the shaft 74 with the interposition of a bearing 77 so as to engage or disengage the arm 75 with respect to the semiannular element 63*b*.

It should be noted that there are means for locking the semiannular element 63*b* in a coplanar position with respect to the semiannular element 63*a*. As to shown, said means can be constituted by a pin 90, which is supported by the supporting structure 66 and can move, by way of the action of a fluid-actuated cylinder 91 connected by means of its body to the supporting structure 66, away from the axis 61*a*, in contrast with a return spring 92, in order to disengage from a seat 93 formed in the semiannular element 63*b*. In practice, the action of the return spring 92 ensures the engagement of the pin 90 with the seat 93 and therefore the support of the semiannular element 63*b* in a position that is coplanar with respect to the semiannular element 63*a*. When the semiannular element 63*b* must be turned over, the pin 90 is disengaged beforehand from the seat 93 by means of the actuation of the fluid-operated cylinder 91.

Conveniently, first axial pushers 80 are provided which interact with the pick-up members 29 of the pick-up device 10, when said device is in the sewing or looping station 102, and with the spikes 62 of the handling device 60 so as to perform the individual transfer of the loops of knitting from the pick-up members 29 to the spikes 62.

Moreover, there are second axial pusher means 81 which interact with the spikes 62 of the handling device 60 in order to produce the passage of the loops of knitting from the spikes 62 of the semiannular element 63*a* to the spikes 62 of the semiannular element 63*b* when the latter is turned over below the semiannular element 63*a*, or to disengage the article from the spikes 62 of the semiannular element 63*b* after the sewing or looping operation, as will become better apparent hereinafter.

The turner 130 is arranged in the sewing or looping station 102 and is composed of a lower portion 131 and an upper portion 132, which can be arranged coaxially to each other along a vertical main axis that coincides with the axis 61*a* of the body 61 of the handling device 60 or with the axis of the hollow cylinder 65, and the body 61 of the handling device 60 is arranged between the lower portion 131 and the upper portion 132 of the turner 130.

The turner 130 comprises a tubular body 137, which can be inserted upward from below through the body 61 of the handling device 60 in order to turn the article 101 that hangs from the spikes 62, everting or overturning it onto its outer lateral surface, as will become better apparent hereinafter.

The lower portion 131 of the turner 130 comprises lower means for supporting the tubular body 137 and lower means for actuating said tubular body 137 along the axis 61*a* in order to make the tubular body 137 pass through the body 61 of the handling device 60 starting from a lowered position, in which the tubular body 137 faces with its upper axial end, in a downward region, the body 61 of the handling device 60, to a raised position, in which it is arranged with its upper axial end above the body 61 of the handling device 60 and with its lower axial end proximate to the body 61 of the handling device 60.

Figure 26:
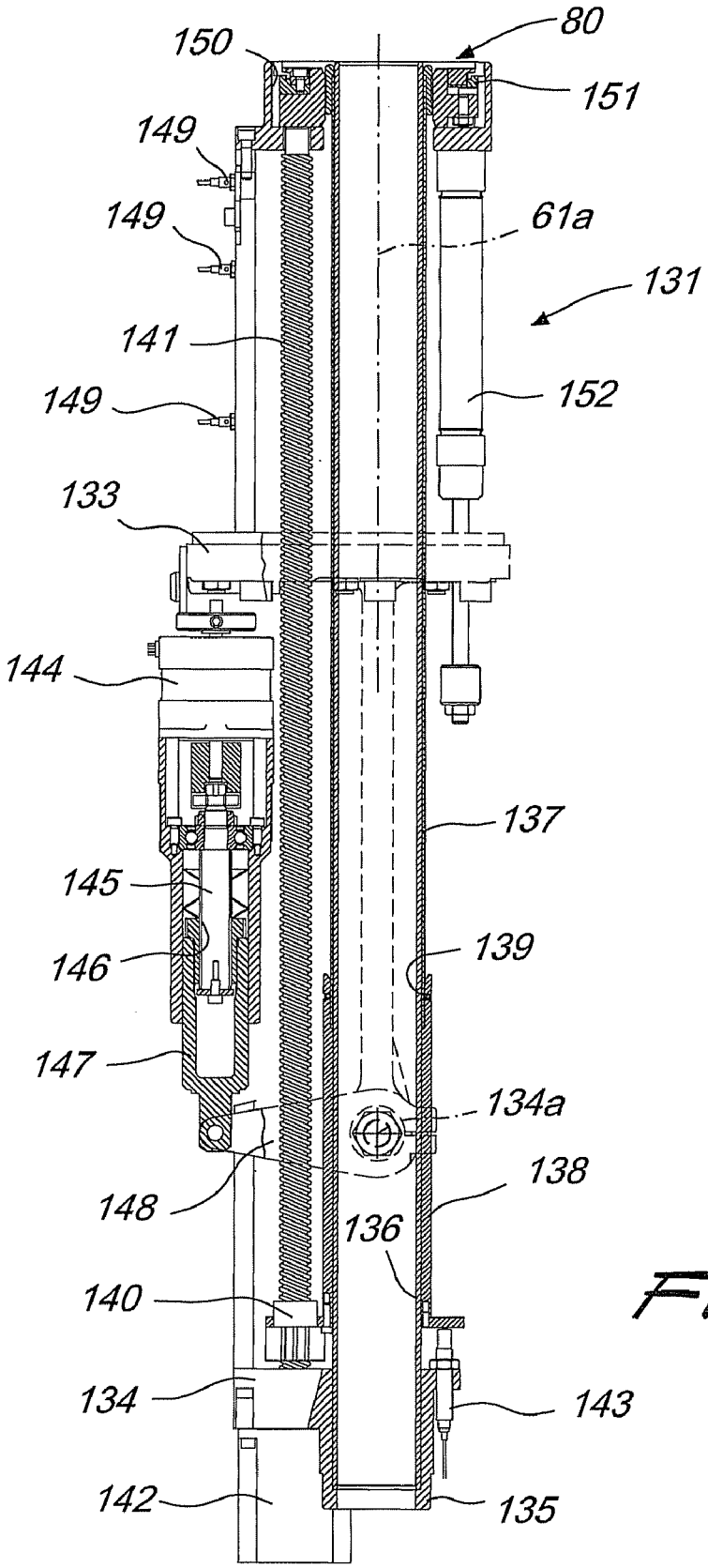
FIG. 26 is a schematic axial sectional view of the lower portion of the turner, with its axis arranged vertically.
Figure 27:
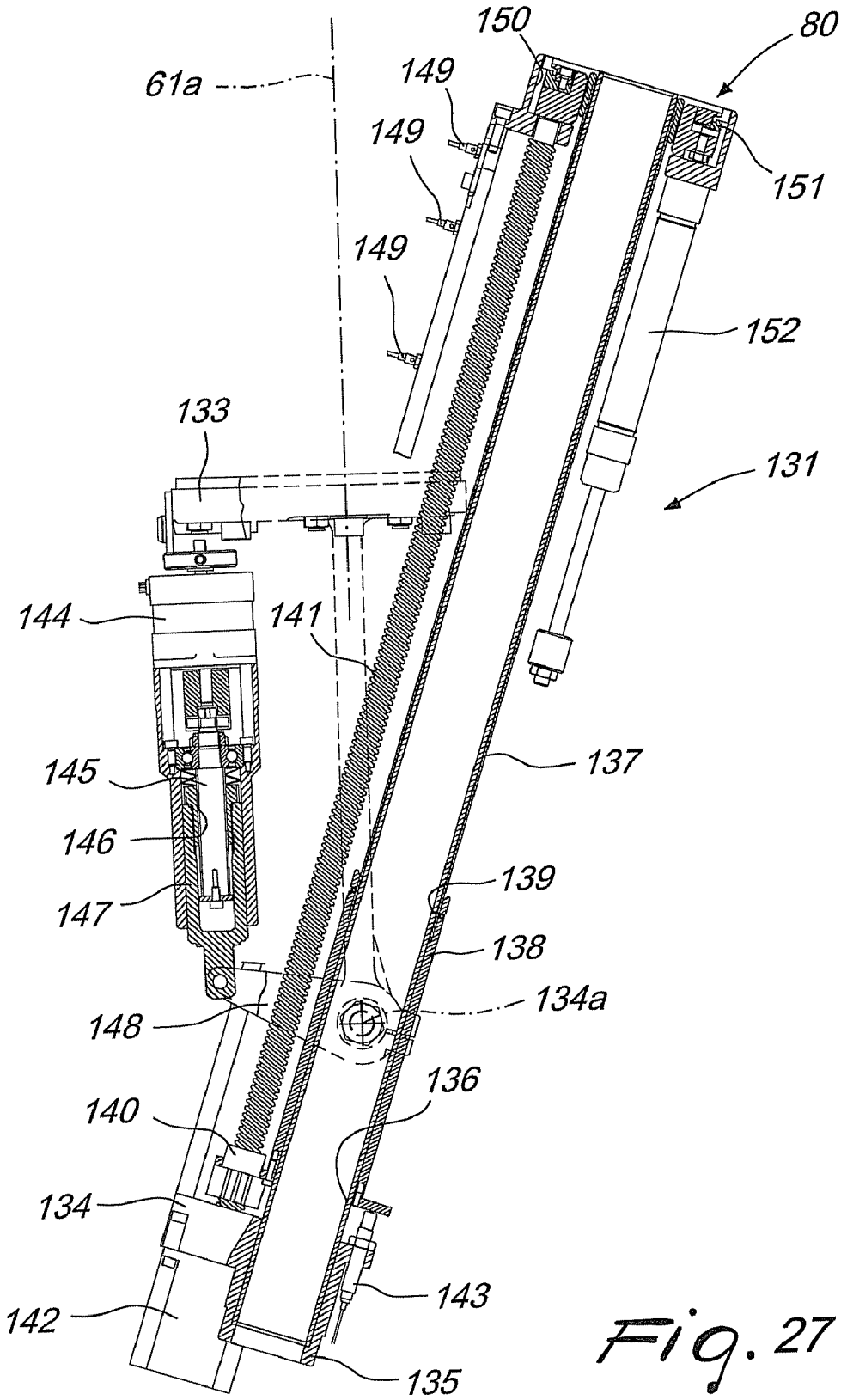

In greater detail, the lower supporting means of the tubular body 137, as shown in particular in FIGS. 26 and 27, comprise a lower supporting structure 133, which can be part of the supporting structure 15 or can be an autonomous supporting structure. The lower supporting structure 133 supports, so that it can rotate about a horizontal axis 134*a*, a frame 134. A footing 135 is fixed to the frame 134 and a hollow lower guiding cylinder 136 is jointly connected to said footing. The lower guiding cylinder 136 is fixed to the footing 135 with its lower end and the horizontal axis 134*a* is positioned in an intermediate region of the axial extension of the lower guiding cylinder 136.

The frame 134 can rotate on command in order to pass from an inclined position, shown in FIG. 27, in which the axis of the lower guiding cylinder 136 is inclined with respect to the vertical so as to approach the machine 100 with its upper end, to a vertical position, shown for example in FIG. 26, in which its axis coincides with the axis 61*a*, and vice versa.

The lower guiding cylinder 136 is adapted to support, so that it can slide axially, the tubular body 137, which is open at its axial ends and can be fitted coaxially around the lower guiding cylinder 136.

The lower actuation means for producing the transfer of the tubular body 137 from the lowered position to the raised position cited above comprise a lower sleeve 138, which is fitted coaxially and so that it can slide axially around the lower guiding cylinder 136. A seat 139 is formed in the upper end of the lower sleeve 138 and the lower axial end of the tubular body 137 can engage therein by resting contact.

The lower sleeve 138 is connected to a block 140 in which there is a female thread that mates with a threaded shaft 141 that is supported so that it can rotate about its own axis by the frame 134 and is oriented so that its axis is parallel to the axis of the lower guiding cylinder 136. The threaded shaft 141 is fixed to the output shaft of an electric motor 142, which is fitted on said frame 134 and can be actuated to turn the threaded shaft 141 and therefore cause the sliding of the lower sleeve 138 along the lower guiding cylinder 136.

The position of the lower sleeve 138 along the lower guiding cylinder 136 can be controlled by means of appropriately provided sensors 143, 149 arranged on the frame 134.

The rotation of the frame 134 about the horizontal axis 134*a* with respect to the lower supporting structure 133 is obtained by means of a linear actuator constituted by an electric motor 144 mounted on the lower supporting structure 133 and connected by means of its output shaft to a threaded shaft 145 that mates with a female thread 146 formed in a hollow shaft 147. Said hollow shaft 147 is pivoted to a lever 148 that is jointly connected to the frame 134 and pivoted to the lower supporting structure 133 about the horizontal axis 134*a*.

In the frame 134, around the upper end of the lower guiding cylinder 136, there is an annular seat 150, which is coaxial to the lower guiding cylinder 136. The first axial pusher means 80 comprise an annular body 151, which can be accommodated coaxially in said annular seat 150. The annular body 151 is connected to the stem of the piston of a fluid-actuated cylinder 152, which is connected by means of its body to the frame 134 and is oriented so that its axis is parallel to the axis of the lower guiding cylinder 136. The fluid-actuated cylinder 152 can be activated in order to cause the movement in one direction or in the opposite direction of the annular body 151 along the axis of the lower guiding cylinder 136.

The perimetric profile of the face of the annular body 151 that is directed upwardly is preferably comb-shaped, with teeth that can be inserted between the pick-up members 29 of the pick-up device 10 when the body 11 of said device is moved into the sewing or looping station 102.

Figure 28:
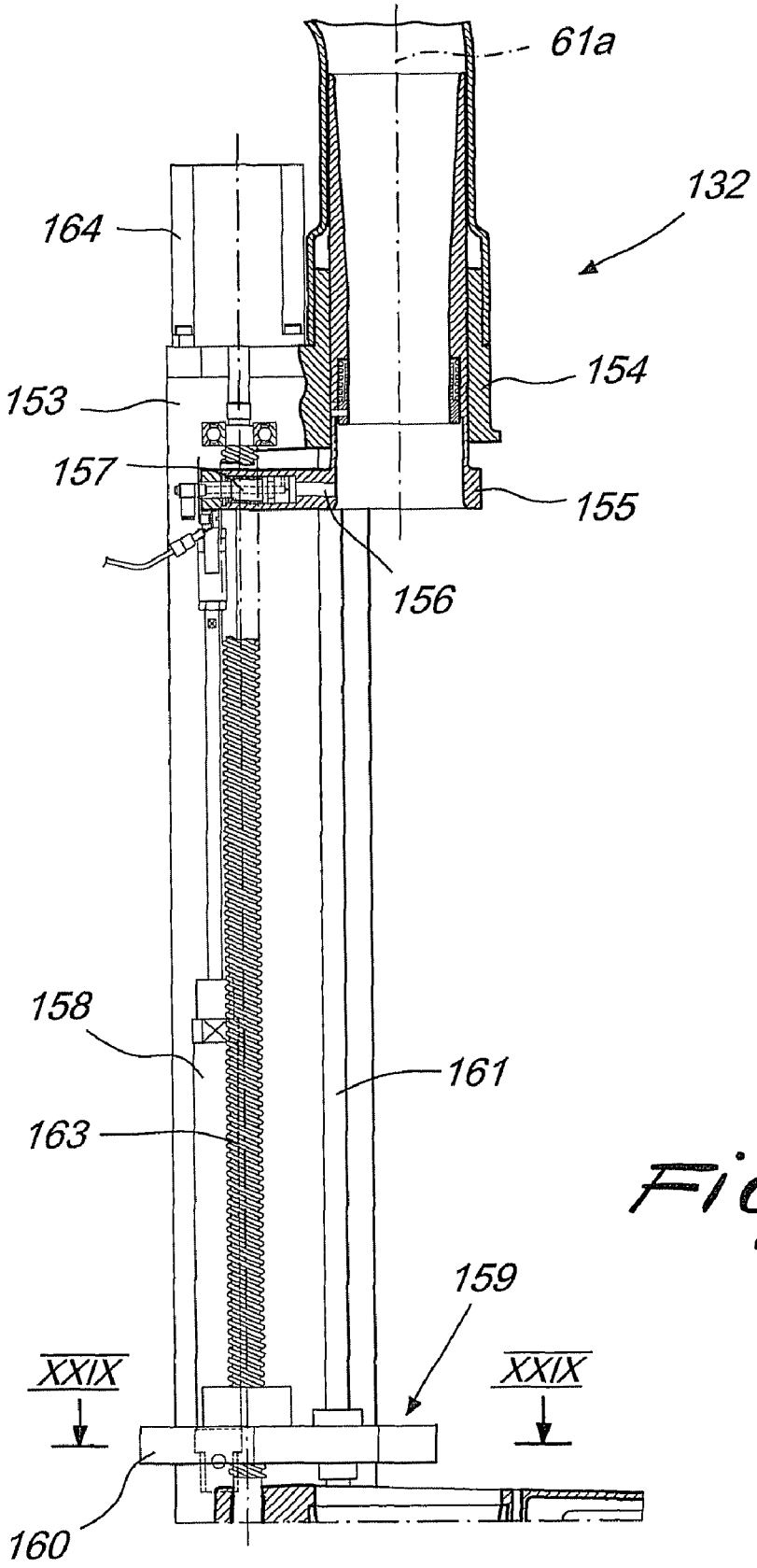
FIG. 28 is a schematic axial sectional view of the upper portion of the turner.

The upper portion 132, as shown in particular in FIG. 28, comprises upper supporting means, which can engage the upper axial end of the tubular body 137, and upper actuation means, for actuating the lifting of the tubular body 137 from the raised position cited above, which can be obtained by means of the actuation of the electric motor 142, to a further raised position, in which its lower axial end is spaced upwardly with respect to the body 61 of the handling device 60.

In greater detail, the upper portion 132 comprises an upper supporting structure 153, which can be an integral part of the lower supporting structure 133 or can be an autonomous supporting structure. The upper supporting structure 153 supports a fixed upper sleeve 154, which is arranged above and coaxially with respect to the hollow cylinder 65.

The upper supporting means and the upper actuation means comprise a movable upper sleeve 155, which mates internally and coaxially with respect to the fixed upper sleeve 154 and can move axially with respect to it.

The lower end of the movable upper sleeve 155 can be mated with the upper axial end of the tubular body 137 and is provided with locking means for engaging said upper axial end of the tubular body 137.

More particularly, the upper axial end of the tubular body 137 has a protruding edge that can be inserted in the lower end of the movable upper sleeve 155. The movable upper sleeve 155 is provided, proximate to its lower end, with a movable pin 156, which is oriented radially with respect to the axis of the movable upper sleeve 155 and is connected to the piston of a fluid-actuated cylinder 157, which is connected by means of its body to the movable upper sleeve 155 and can be actuated to move the movable pin 156. The movable pin 156, as a consequence of the actuation of the fluid-actuated cylinder 157, can protrude radially from the internal surface of the movable upper sleeve 155, forming a lower stop shoulder for the protruding edge of the upper axial end of the tubular body 137, inserted in the movable upper sleeve 155, contrasting its extraction from said movable upper sleeve 155 and thus supporting the tubular body 137.

The movable upper sleeve 155 is connected to the stem of the piston of a fluid-actuated cylinder 158, which is connected by means of its body to the upper supporting structure 153 and is oriented so that its axis is parallel to the axis of the movable upper sleeve 155. The fluid-actuated cylinder 158 can be activated so as to cause the movement of the movable upper sleeve 155 along its own axis with respect to the fixed upper sleeve 154.

Advantageously, the upper portion 132 of the turner 130 comprises auxiliary sliding means 159, which face the outer lateral surface of the tubular body 137, when it protrudes upwardly from the hollow cylinder 65. These auxiliary sliding means 159 can move on command with respect to the tubular body 137 parallel to the axis 61*a* and can engage and disengage cyclically the article 101 that is everted onto the outer lateral surface of the tubular body 137, so as to actuate its sliding in the direction of the lower axial end of the tubular body 137.

Figure 29:
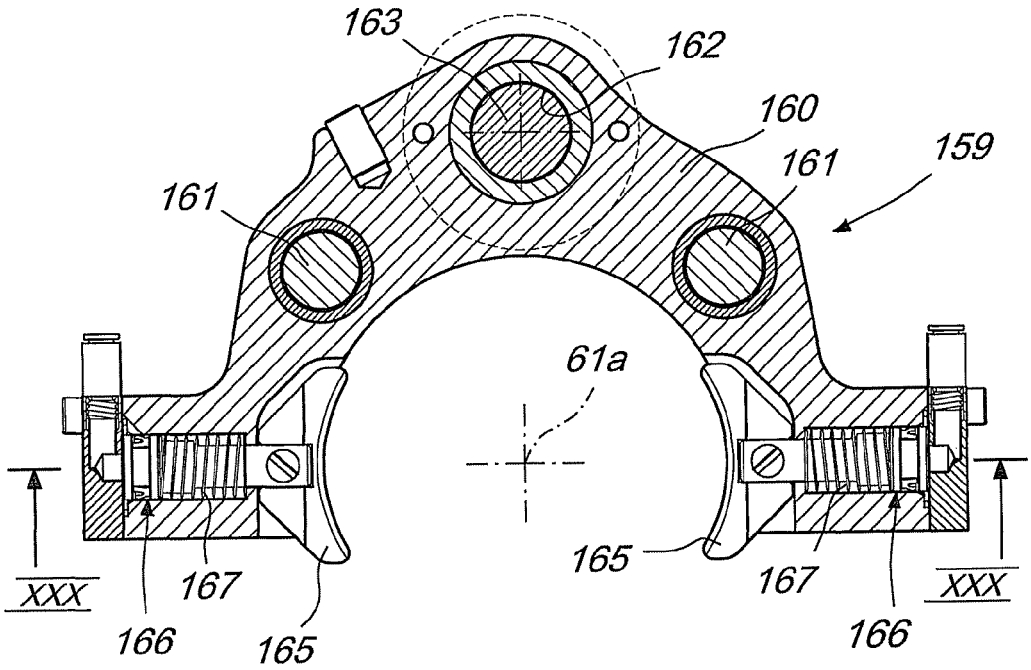
FIG. 29 is an enlarged-scale sectional view of FIG. 28, taken along the line XXIX-XXIX.
Figure 30:
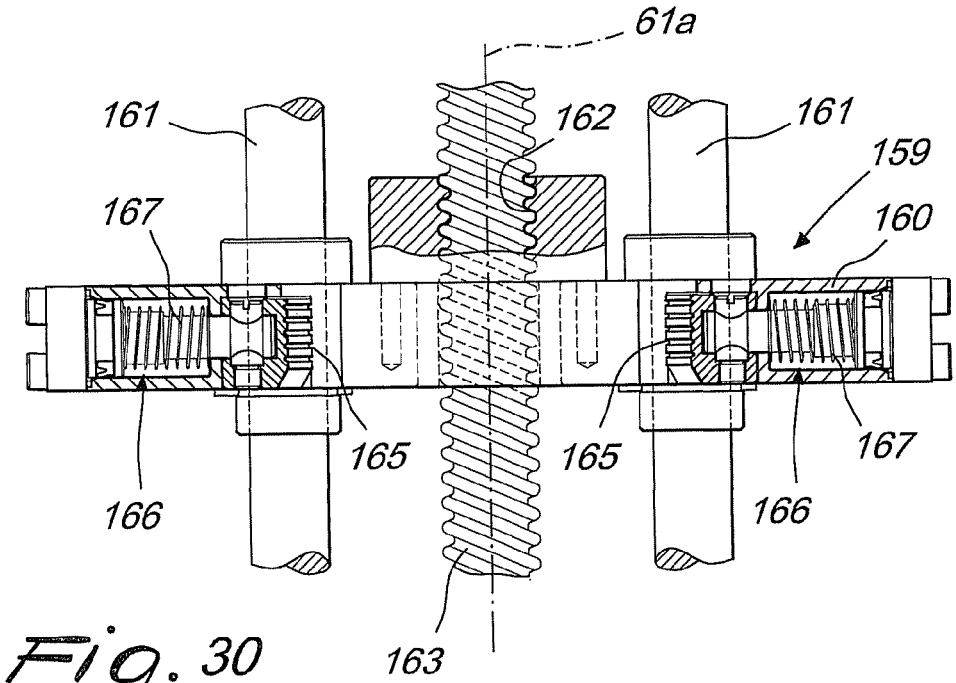
FIG. 30 is a sectional view of FIG. 29, taken along a plane passing through line XXX-XXX.

The auxiliary sliding means 159, shown in particular in FIGS. 28, 29 and 30, comprise a slider 160, which is coupled slidingly to columns 161 having a vertical axis, which are fixed to the upper supporting structure 153. A female thread 162 is formed in the slider 160, and a threaded shaft 163 mates with it and is supported, so that it can rotate about its vertically oriented axis, by the upper supporting structure 153. The threaded shaft 163 is connected to the output shaft of an electric motor 164, which is mounted on the upper supporting structure 153. In practice, the actuation of the electric motor 164 produces the upward or downward sliding of the slider 160 along the columns 161, i.e., parallel to the axis 61*a*.

The slider 160 supports, in two regions that are diametrically mutually opposite with respect to the axis 61*a*, two pressers 165, which face each other and can move toward each other by way of the action of corresponding fluid-actuated cylinders 166 mounted on the slider 160 in contrast with the action of springs 167 or away from each other by way of the action of the springs 167, so as to engage or disengage the outer lateral surface of the tubular body 137 or the article 101 everted onto the outer lateral surface of the tubular body 137. The mutually facing faces of the pressers 165 are shaped like a portion of a cylindrical surface, so as to mate with the outer lateral surface of the tubular body 137. Optionally, these faces of the pressers 165 can be knurled or toothed in order to increase their adhesion to the article 101.

It should be noted that both the lower end of the lower guiding cylinder 136 and the fixed upper sleeve 154 can be connected on command to pneumatic suction means of a known type, not shown for the sake of simplicity, in order to produce an downward or upward suction through the tubular body 137.

The second axial pusher means 81 comprise an annular actuation body 82, which is fitted coaxially around the hollow cylinder 65 and is jointly connected thereto for rotation about the axis 61*a* with respect to the supporting structure 66. The annular actuation body 82 is connected to the hollow cylinder 65 by means of vertical guiding rods 83, shown in FIGS. 6 to 11 and 17, around which there are springs 84 that contrast the descent of the annular body 82 with respect to the hollow cylinder 65.

The piston of at least one fluid-actuated cylinder 85, mounted on the supporting structure 66 and oriented so that its axis is vertical, acts on command on the annular actuation body 82. The actuation of the fluid-actuated cylinder 85 causes the descent of the annular actuation body 82 with respect to the hollow cylinder 65 in contrast with the action of the springs 84 that act as return springs. A bearing 86 is interposed between the annular actuation body 82 and the piston of the fluid-actuated cylinder 85 and prevents scraping between these two components during the rotation of the hollow cylinder 65 about its own axis, which coincides with the axis 61*a*.

Inside the cylindrical surface along which the spikes 62 are arranged when the semiannular elements 63*a* and 63*b* are coplanar, in the body 61 of the handling device 60 there is an annular seat 87, which is delimited radially outwardly indeed by the spikes 62.

This annular seat 87 accommodates an annular contact body 88, which is also provided in two halves in a manner similar to the semiannular elements 63*a* and 63*b*. Each of the two halves of the annular contact body 88 can move parallel to the axis 61*a* with respect to the spikes 62 by way of the action of the annular actuation body 82, which, when pushed downwardly by the fluid-actuated cylinder 85, acts on the annular contact body 88, by means of rods 89, visible only in FIGS. 12 to 16, causing its descent. The rise of the annular contact body 88 when the action of the fluid-actuated cylinder 85 ceases can be achieved by means of return springs. It should be noted that the rods 89 that act on the half of the annular contact body 88 that is arranged in the semiannular element 63*a* fixed to the hollow cylinder 65 can be fixed to said half of the annular contact body 88, while the rods 89 that act on the other half of the annular contact body 88 arranged in the semiannular element 63*b* that can be turned over are conveniently provided in two distinct parts, indeed to allow the overturning of the semiannular element 63*b* about the diametrical axis 64 with respect to the semiannular element 63*a*. In FIGS. 12, 12*a*, 14 and 16, the annular actuation body 82, the hollow cylinder 65 and the annular contact body 88 are shown in cross-section along planes that are different from the sectional planes used in FIGS. 6 to 11 and 17 in order to show the second axial pusher means 81.

The sewing or looping head 170 is arranged in the sewing or looping station 102 and is provided, in a per se known manner, with sewing elements or members, constituted by a needle 171 and a crochet or by a needle 171 and a yarn loading spool or by two needles 171 and 172 as shown, so as to form a sewing or looping chain stitch 173. The sewing or looping head 170 is further provided, proximate to the sewing elements, with a bearing 174 that has a horizontal axis and is designed to support the semiannular element 63*b* when it is turned over below the semiannular element 63*a* and while it is turned about the axis 61*a* together with the hollow cylinder 65 by way of the actuation of the electric motor 69.

The sewing or looping head 170 is provided with an electric motor 175 for the actuation of the sewing elements, and the actuation of this electric motor 175 is synchronized with the actuation of the electric motor 69, so that in each instance the needle 171 of the sewing or looping head 170 engages a spike 62 of the semiannular element 63*b* that carries a pair of loops of knitting of the article 101, joining them.

The sewing or looping head 170 is provided with a cutter, of a known type which is not shown for the sake of simplicity, for cutting the sewing or looping chain stitch 173 at the end of the sewing or looping operation.

Conveniently, the sewing or looping head 170 is mounted on a slider 176 that is jointly connected to guiding shafts 177 that are oriented so that their axes are horizontal and are supported, so that they can slide along their own axes, by the supporting structure 66. A linear actuator acts on the slider 176 and is of a known type, not shown for the sake of simplicity, such as for example a fluid-actuated cylinder or an electric motor connected to the slider 176 by means of a screw-and-nut connection, and causes the translational motion on command of the slider 176 and therefore of the sewing or looping head 170 toward the axis 61*a*, so as to move the sewing or looping head 170 into a position that is adapted to interact with the spikes 62 of the semiannular element 63*b* or away from the axis 61*a* so as to not hinder the positioning of the body 11 of the pick-up device 10 in the sewing or looping station 102 and the overturning of the semiannular element 63*b* with respect to the semiannular element 63*a* about the diametrical axis 64.

The apparatus 1 is completed by other sensors, which are not described in detail for the sake of simplicity, for controlling the movement of the several movable elements that compose the apparatus 1. The several sensors, as well as the several actuators needed to actuate the movable elements of the apparatus, are functionally connected to an actuation and control element of the electronic programmable type, which supervises the operation of the apparatus. This actuation and control element can be constituted by a single actuation and control element that supervises both the operation of the apparatus 1 and the operation of the machine 100 as a function of preset operating programs.

Operation of the apparatus in performing the method according to the invention is as follows.

For the sake of simplicity and for greater clarity, the method will be described with reference to the production of a tubular article 101 with a single-cylinder circular machine that corresponds to the case shown in the drawings.

The article 101 is produced on the circular knitting machine for hosiery or the like, beginning its production from an axial end and ending it at the opposite axial end.

While the machine 100 is ending the production of the article 101, the pick-up device 10 is arranged with its body 11 in an intermediate position between the machine 100 and the sewing or looping station 102, with the pick-up members 29 in a position that is spaced from the axis 11*a* of the body 11. The presser 42 is arranged above and coaxially with respect to the body 11 and is raised with respect to it.

Each loop of knitting of the last row of knitting that is formed is retained on the needle 123 that produced it. The dial, not shown for the sake of simplicity, which is arranged above and coaxially with respect to the needle cylinder 121, after the cutter jointly connected to the dial has cut the yarn used to produce the article 101, is moved away upwardly from the needle cylinder 121 to allow the positioning, above and coaxially with respect to the needle cylinder 121, of the body 11 of the pick-up device 10 with the corresponding presser 42 arranged above and coaxially with respect to the body 11.

It should be noted that the pick-up device 10 is arranged with the body 11 above the needle cylinder 121 and is then lowered along the axis 11*a*, which coincides with the axis 121*a*, by way of the actuation of the electric motor 27 so that the centering pin 31 is inserted in the appropriately provided seat formed in the supporting structure of the machine 100.

The needle cylinder 121 continues to be actuated with a rotary motion about its own axis 121*a* so that the needles 123, by means of the needle actuation cams, are first raised into the held stitch position and then returned with their head 123*c* below the sinkers 125 to be then raised again into the held stitch position, simultaneously lifting the suction tube 124 so that the loops of knitting of the last row of knitting of the article 101 that have been formed are assuredly within the head 123*c* of the corresponding needle 123 with the latches 123*d* of the needles 123 open. Finally, the needles 123, again by means of the rotation of the needle cylinder 121 with respect to the needle actuation cams, are all raised into the drop stitch position together with the suction tube 124 (FIG. 1). At this point, the rotation of the needle cylinder 121 is stopped and the needle cylinder 121 is locked mechanically so as to exclude a random or accidental rotation thereof during subsequent steps. In this rotational position of the needle cylinder 121, the end 29*a* of each pick-up member 29 that is directed toward the axis 11*a* is aligned radially with the stem 123*b* of a corresponding needle 123.

Figure 2:
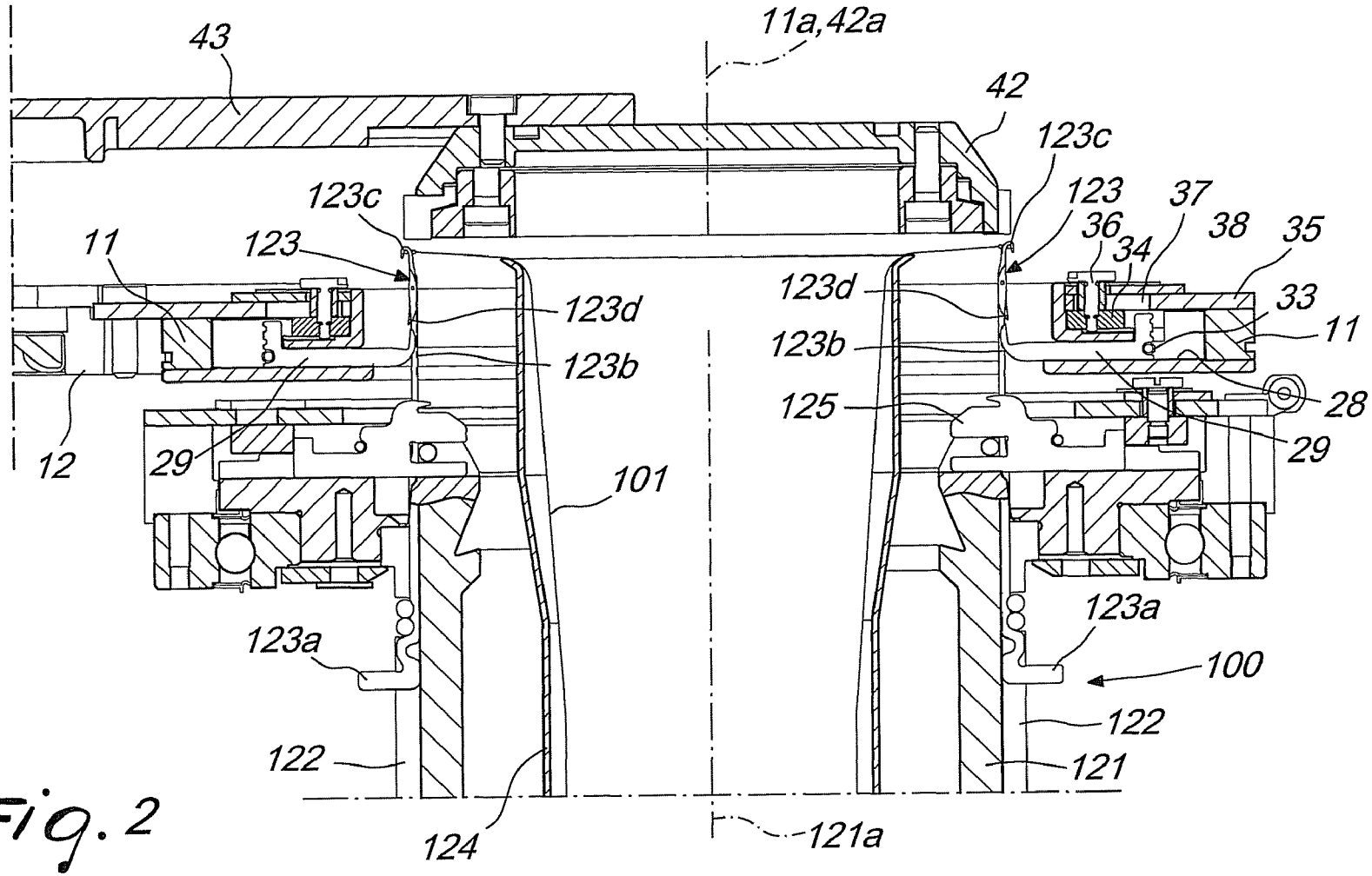

At this point, the fluid-actuated cylinder 40 is activated and, by turning the movable plate 38, causes the movement of the radial pushers 34 toward the axis 11*a*, thus allowing the pick-up members 29 to move toward the axis 11*a* by way of the action of the thrust applied by the spring 33. The end of each pick-up member 29 that is directed toward the axis 11*a* rests with the seat 30 against the stem 123*b* of the corresponding needle 123 directly below the latch 123*d* of said needle 123, as shown in FIG. 2 and in greater detail in FIGS. 23 and 25, which illustrate exclusively the coupling of a pick-up member 29 with a needle 123.

After the engagement of the pick-up members 29 against the stem 123*b* of the corresponding needle 123, the body 11 is raised slightly, by means of the actuation of the electric motor 27, so that the end 29*a* of each pick-up member 29 engages, by means of the seat 30, the stem 123*b* of the needle 123 between the free end of the open latch 123*d* of a needle 123 and the stem 123*b* of said needle 123.

The suction tube 124 is then lowered and, by way of the actuation of the fluid-actuated cylinder 50, the presser 42 is moved to the lowered position, in which it penetrates with the teeth of its peripheral profile between the needles 123 and between the pick-up members 29. As a consequence of this axial movement of the presser 42, the loops of knitting are pushed into the hook-shaped end 29*a* of the pick-up members 29 below the latches 123*d* of the needles 123 (FIG. 3 and, in greater detail, FIG. 24). Moreover, the pin 51 engages in the seat 52, jointly connecting in rotation about the axis 13*a* the arm 12 and the arm 43.

The body 11 of the pick-up device 10 is then raised along its own axis 11*a* with respect to the needle cylinder 121 together with the presser 42 by way of the actuation of the electric motor 27. This lifting, by way of the sliding toward the head 123*c* of the corresponding needle 123 of the pick-up members 29 previously arranged with their end 29*a* below the open latch 123*d* of the corresponding needle 123, causes the closure of the latches 123*d* on the heads 123*c* of the needles 123 and the disengagement of the loops of knitting from the needles 123 (FIG. 4).

In this step, the suction tube 124 is raised again in order to assist the rise of the article 101 and to protect the article 101 against contact with the parts of the machine arranged around the needles 123 in the subsequent step.

By way of the actuation of the electric motor 20, the arms 12 and 43 are then rotated about the axis 13*a* so as to transfer the body 11 of the pick-up device 10 and the presser 42 from the machine 100 to an intermediate position between the machine 100 and the sewing or looping station 102 (FIG. 5). In this intermediate position, the fluid-actuated cylinder 50 is deactivated so that the arm 43, which carries the presser 42, disengages with its pin 51 from the seat 52. Moreover, in this intermediate position, the lower portion 131 of the turner 130 can be inclined, by way of the actuation of the electric motor 144, with respect to the axis 61*a* in order to move the upper axial end of the tubular body 137, in the lowered position, toward the machine 100, as shown in FIG. 27 and shown in broken lines in FIG. 6, aspirating inside it the article 101 while it is extracted upwardly from the needle cylinder 121 of the machine 100.

Figure 6:
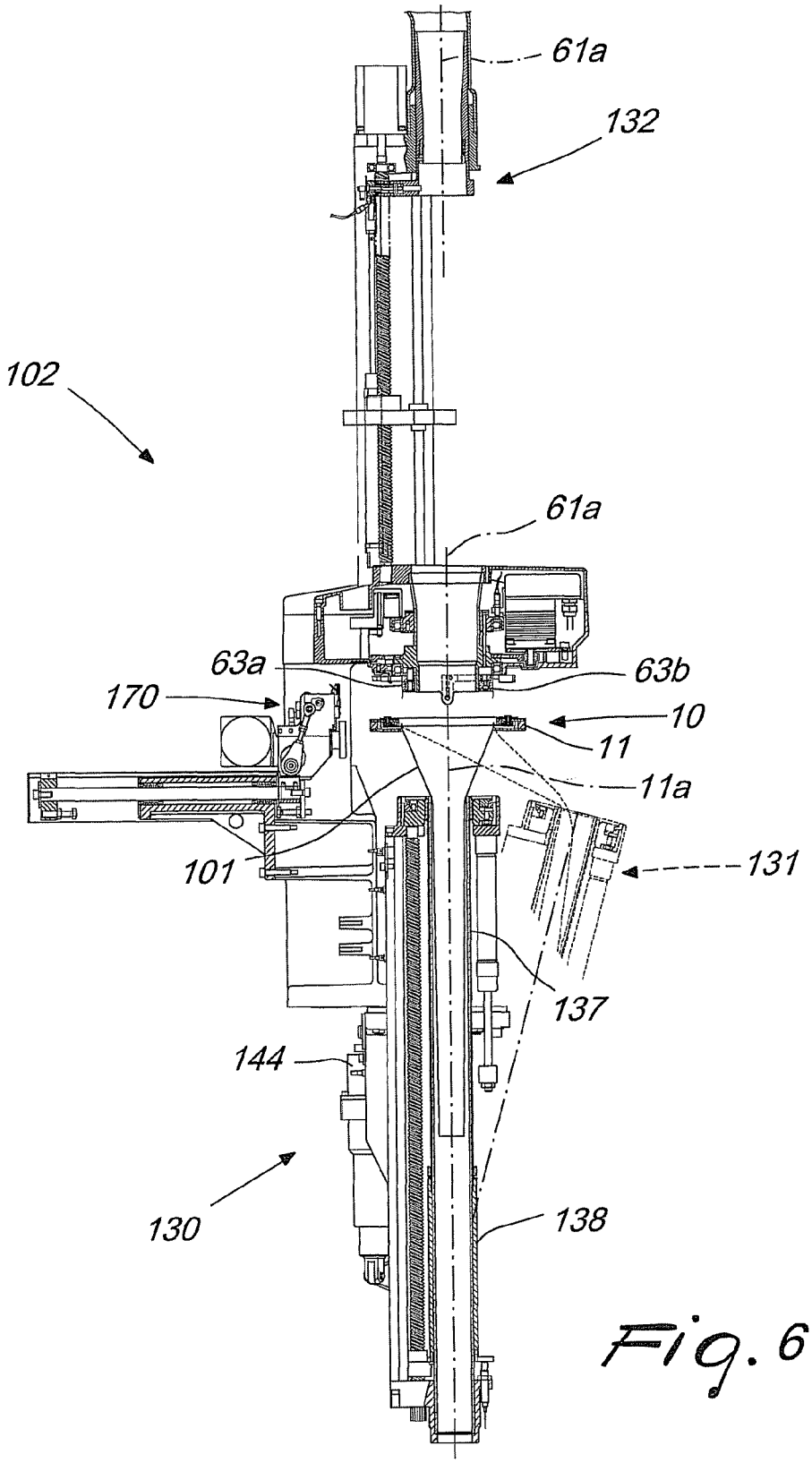
FIG. 6 is a schematic view of the step for positioning the article at a sewing or looping station in which the handling device and the turner, shown in axial cross-section, are arranged.
Figure 6A:
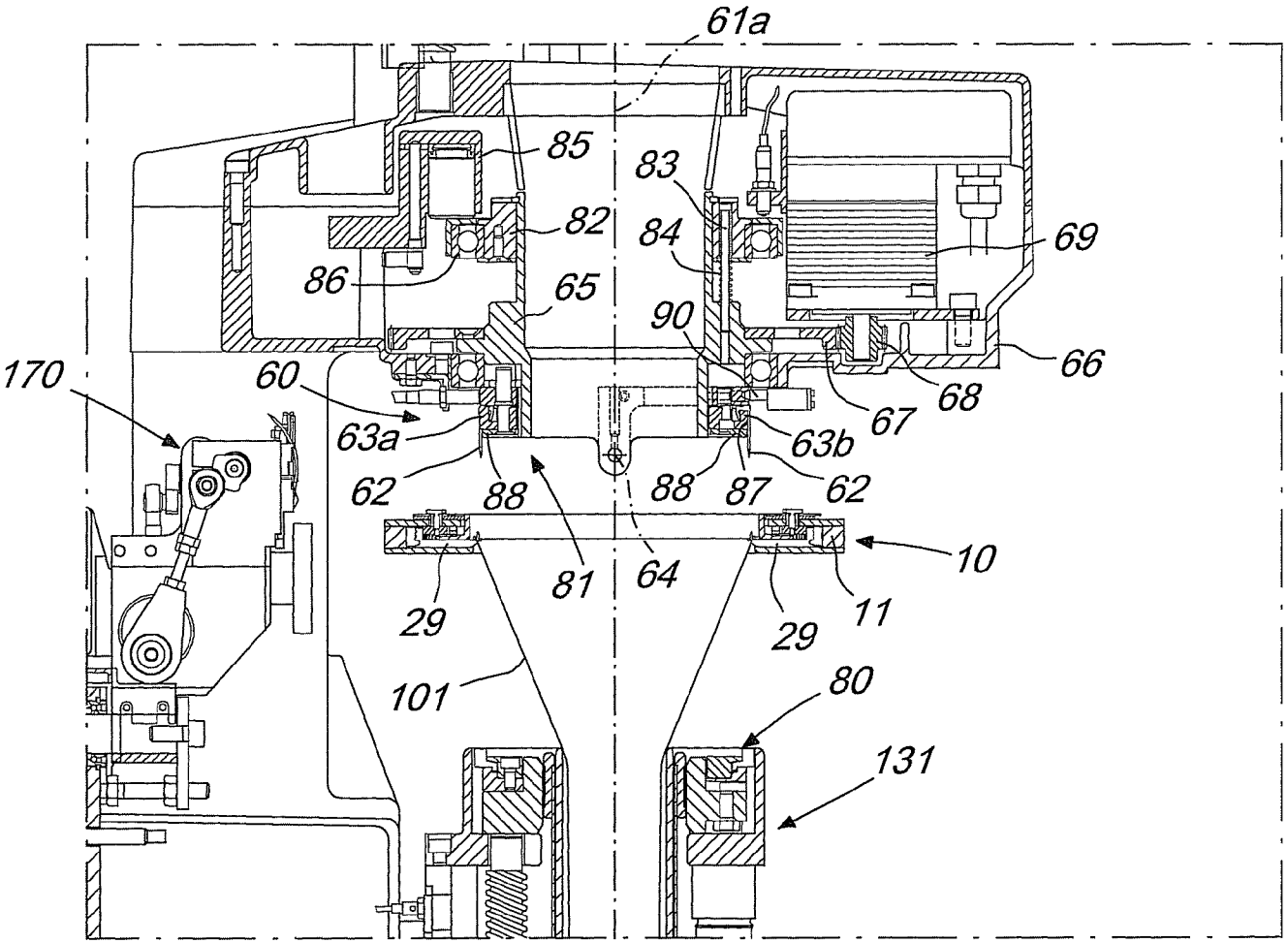
FIG. 6*a* is an enlarged-scale view of a detail of FIG. 6.

The rotation of the arm 12 about the axis 13*a* by means of the electric motor 20 is then completed so as to bring the body 11 with its axis 11*a* at the axis 61*a* while the lower portion 131 is also returned with the axis of the tubular body 137 at the axis 61*a* (FIGS. 6 and 6*a*). It should be noted that in completing the rotation of the arm 12 about the axis 13*a*, the arm 43 does not follow the arm 12, since its rotation is blocked by the abutment 54 and the slot 53 slides along the pin 51, disengaging from it.

Figure 7:
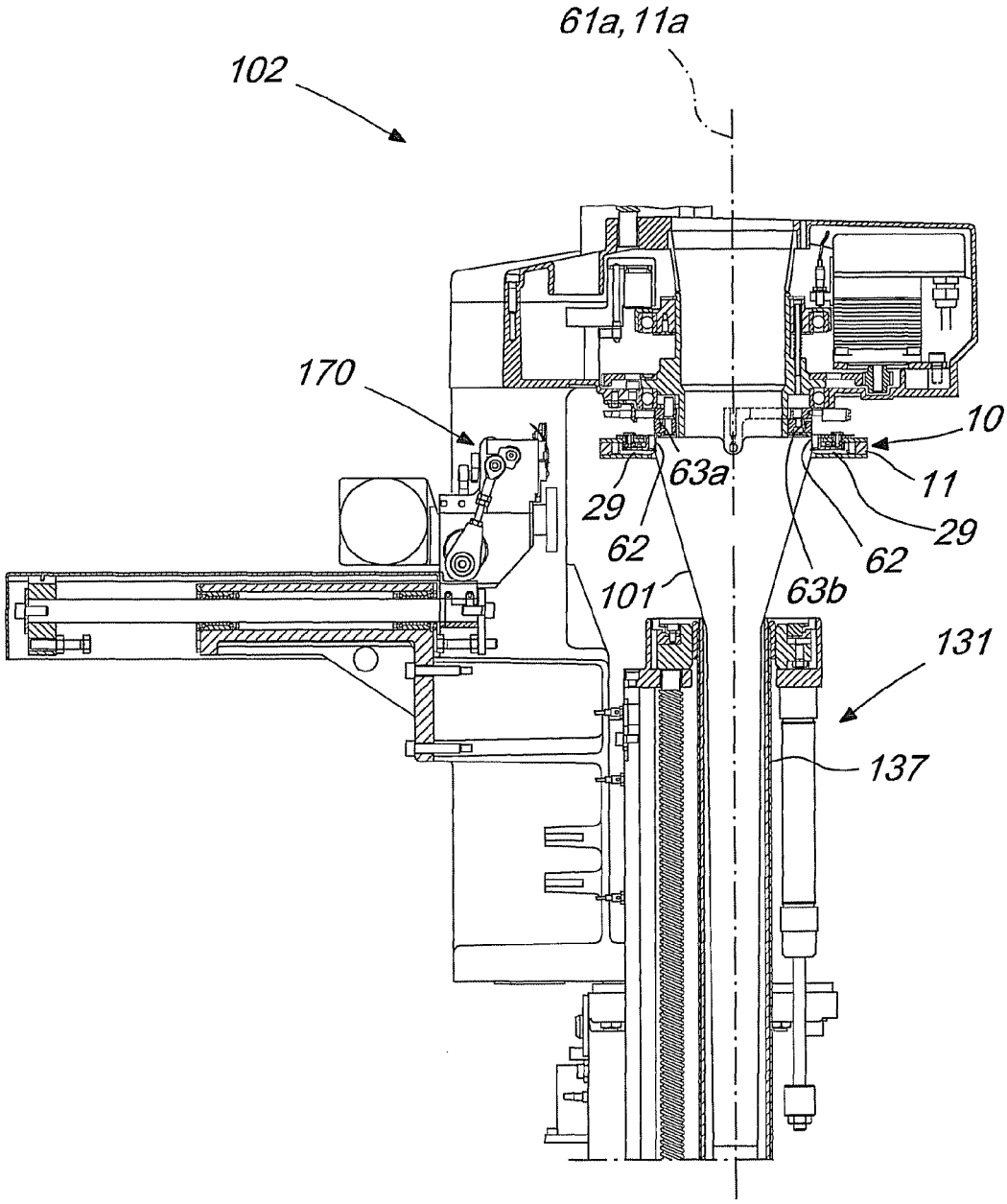
FIGS. 7 and 8 are schematic enlarged-scale views of a detail of the elements shown in FIG. 6, illustrating the step for individual passage of the loops of knitting from the pick-up members of the pick-up device to the spikes of the handling device, with the handling device and the turner shown in axial cross-section.
Figure 7A:
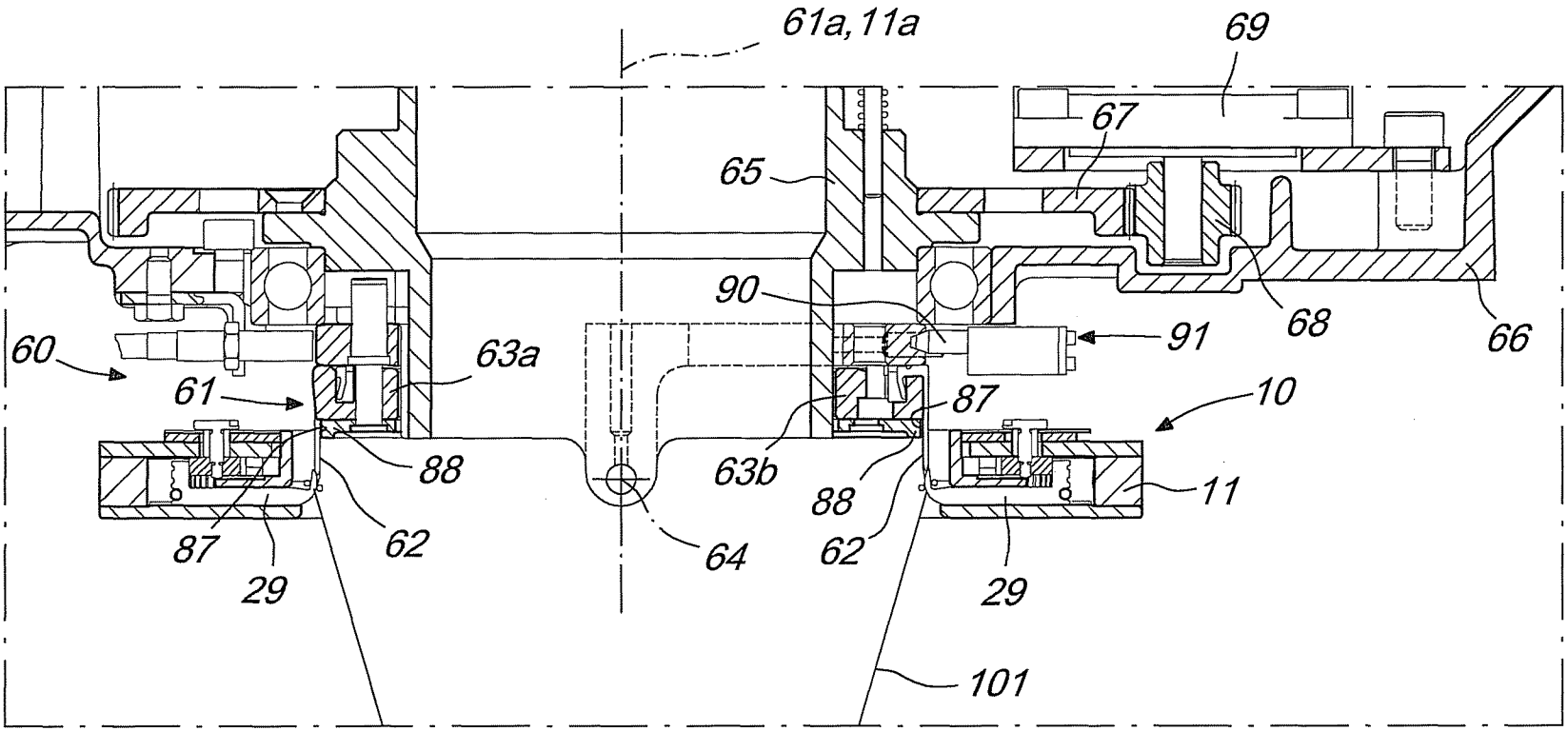
FIGS. 7*a* and 8*a* are enlarged-scale views of details respectively of FIG. 7 and FIG. 8.

The body 11, which lies between the upper axial end of the tubular body 137, supported by the lower sleeve 138, and two semiannular elements 63*a*, 63*b*, in a coplanar position, is then raised by means of the actuation of the electric motor 27 so that each seat 30 of the pick-up members 29 fits onto a spike 62, starting from its lower end (FIGS. 7 and 7*a*).

Figure 8:
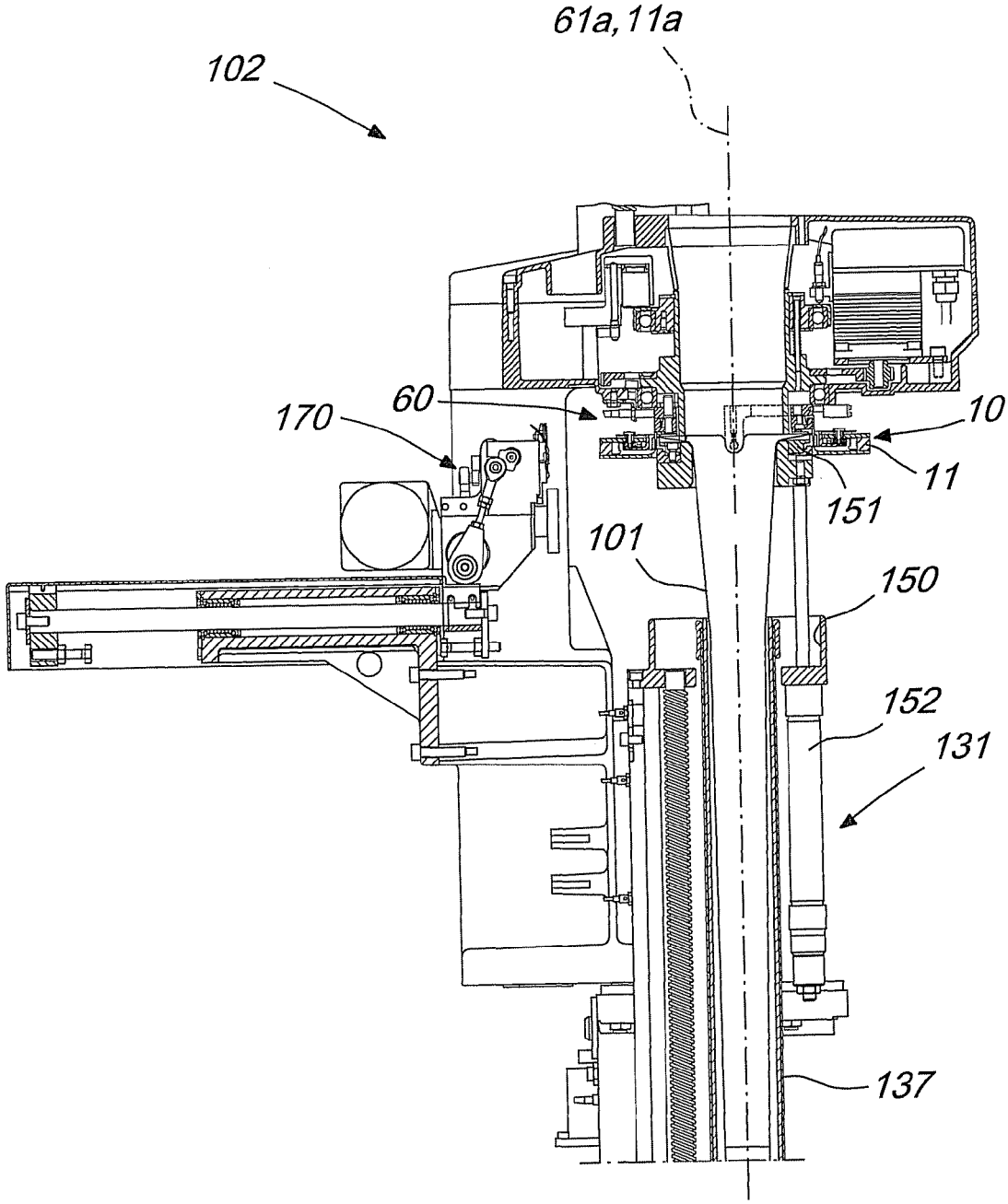
Figure 8A:
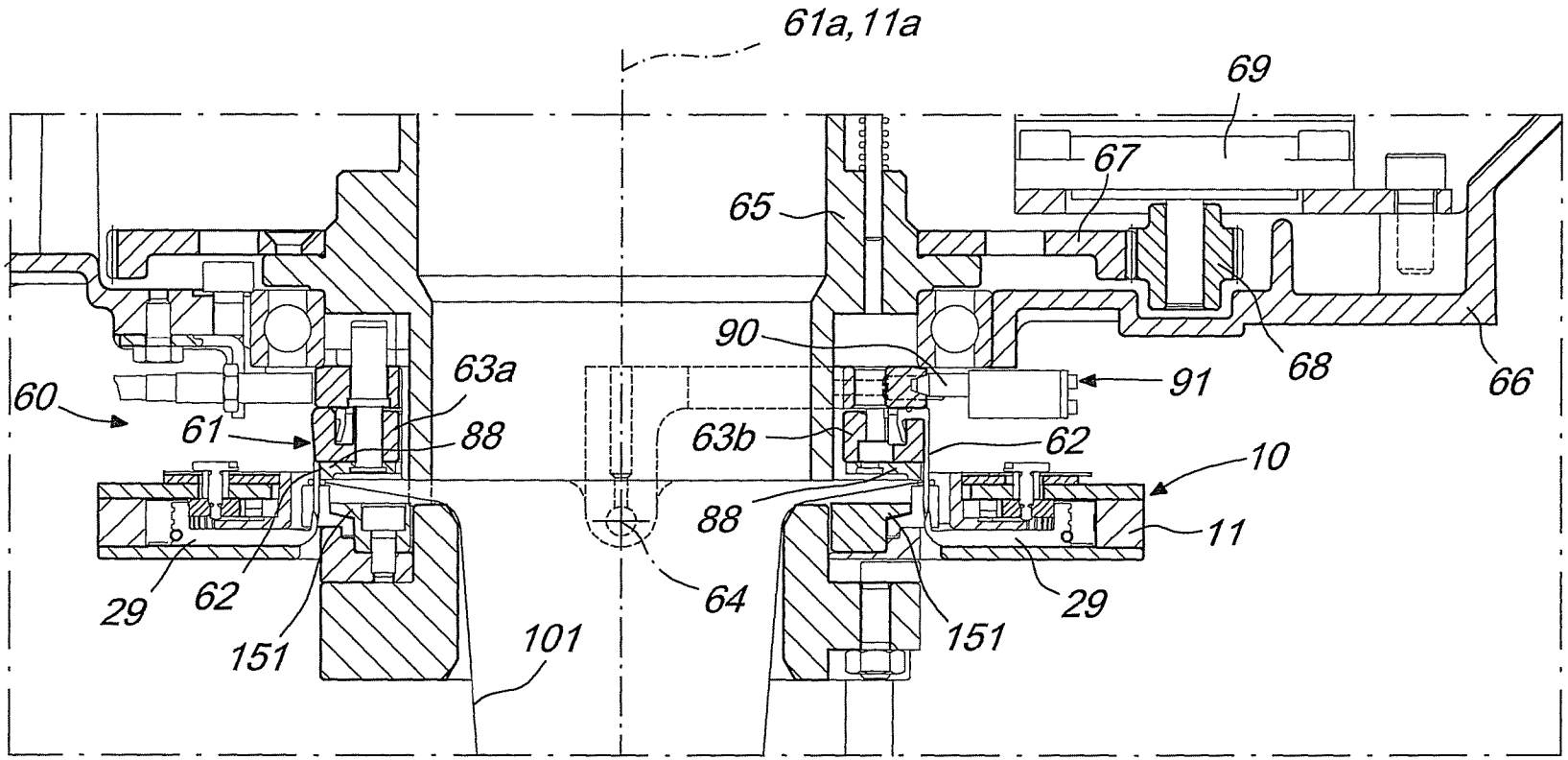

The fluid-actuated cylinder 152 is then activated and causes the lifting of the annular body 151 along the axis 61*a*. The annular body 151 penetrates with the teeth of its peripheral profile between the pick-up members 29, causing the individual passage of the loops of knitting from the pick-up members 29 to the spikes 62. In this manner, each spike 62 carries a loop of knitting of the last row of knitting formed by the needles 123 of the machine 100 (FIGS. 8 and 8*a*).

Figure 9:
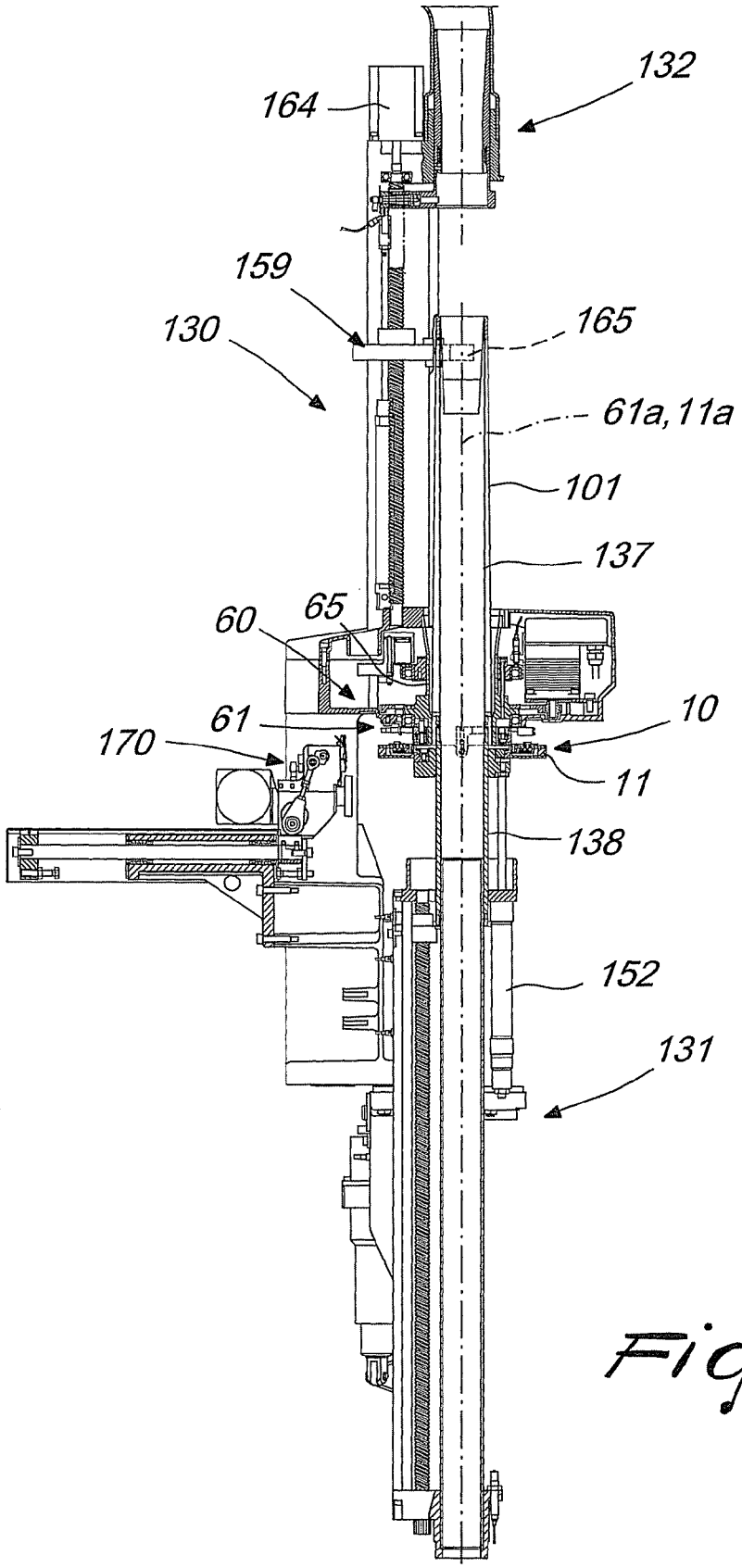
FIGS. 9 to 11 are schematic sectional views, similar to FIG. 6, of the step for turning the article retained by the handling device.

While the annular body 151 is kept in the raised position, by way of the actuation of the electric motor 142, the lifting along the axis 61*a* of the lower sleeve 138 and therefore of the tubular body 137 is actuated, said body 137 crossing, with its upper axial end, the body 11 and the body 61 of the handling device 60, passing within the hollow cylinder 65 and reaching the raised position (FIG. 9). This upward translational motion of the tubular body 137 turns the article 101, which hangs by its last formed row of knitting from the spikes 62, above said spikes 62. The lifting of the tubular body 137 is stopped when its lower axial end lies directly above the body 61, constituted by the two semiannular elements 63*a*, 63*b*, which are still in a coplanar position. If the article 101 is shorter than the axial space occupation of the tubular body 137, the upward translational motion alone of the tubular body 137 is sufficient to complete the turning of the article 101.

If the article 101 instead is longer, its turning onto the outer lateral surface of the tubular body 137 is completed by the auxiliary sliding means 159.

More particularly, with the tubular body 137 in the raised position, the pressers 165, by way of the combined actuation of the fluid-actuated cylinders 166 and of the electric motor 164, are cyclically engaged with the portion of the article 101 that is already everted onto the outer lateral surface of the tubular body 137 and simultaneously lowered and then disengaged from the article 101 and simultaneously raised so as to push the article 101 toward the lower axial end of the tubular body 137, until its extraction from the upper axial end of the tubular body 137 is completed.

Figure 10:
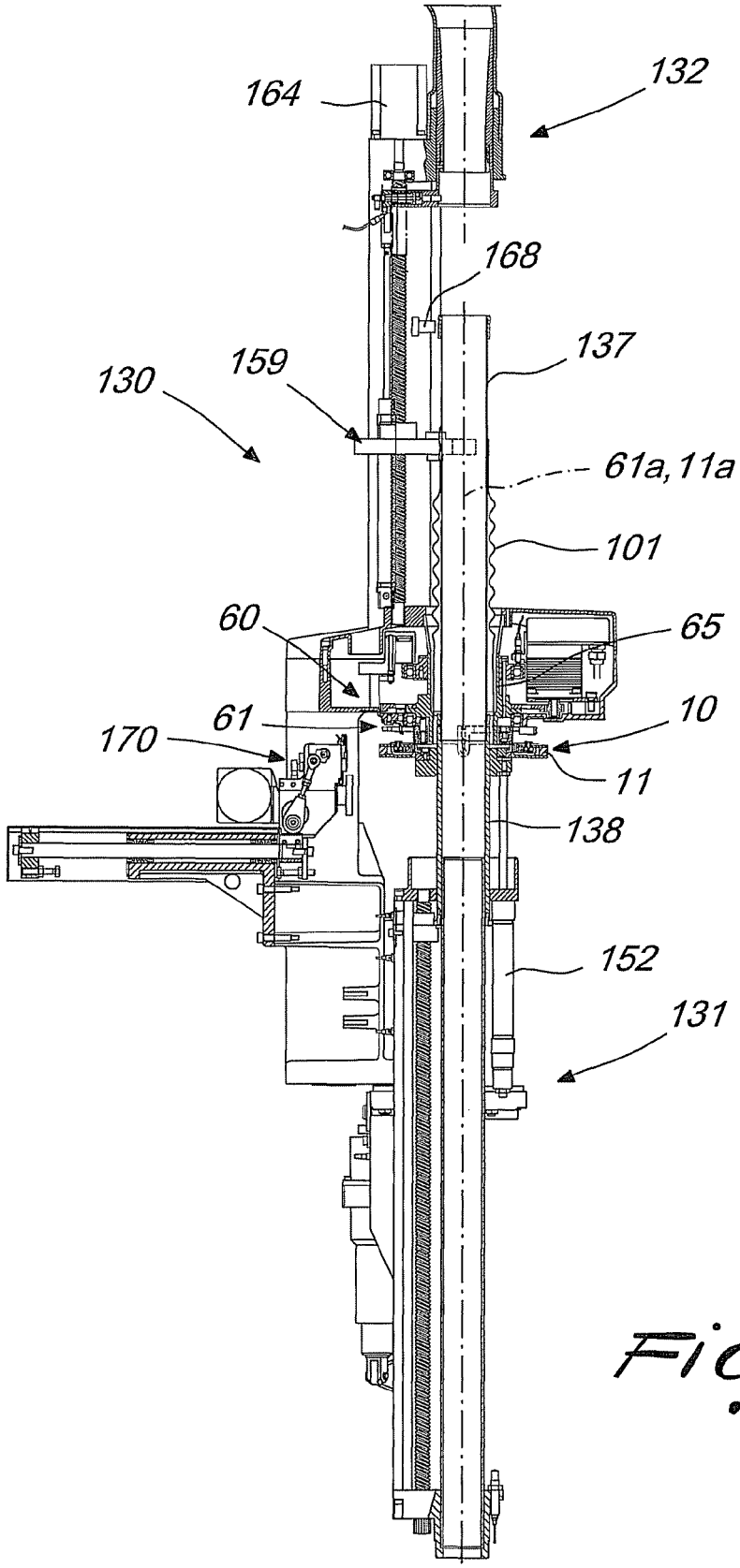

Completion of the eversion of the article 101 onto the outer lateral surface of the tubular body 137 can be detected by means of an optical detector, constituted for example by a photocell 168 that faces the upper edge of the tubular body 137 and inhibits the actuation of the auxiliary sliding means 159 if their intervention is not necessary or ceases their actuation when they have completed the eversion of the article 101 (FIG. 10).

Figure 11:
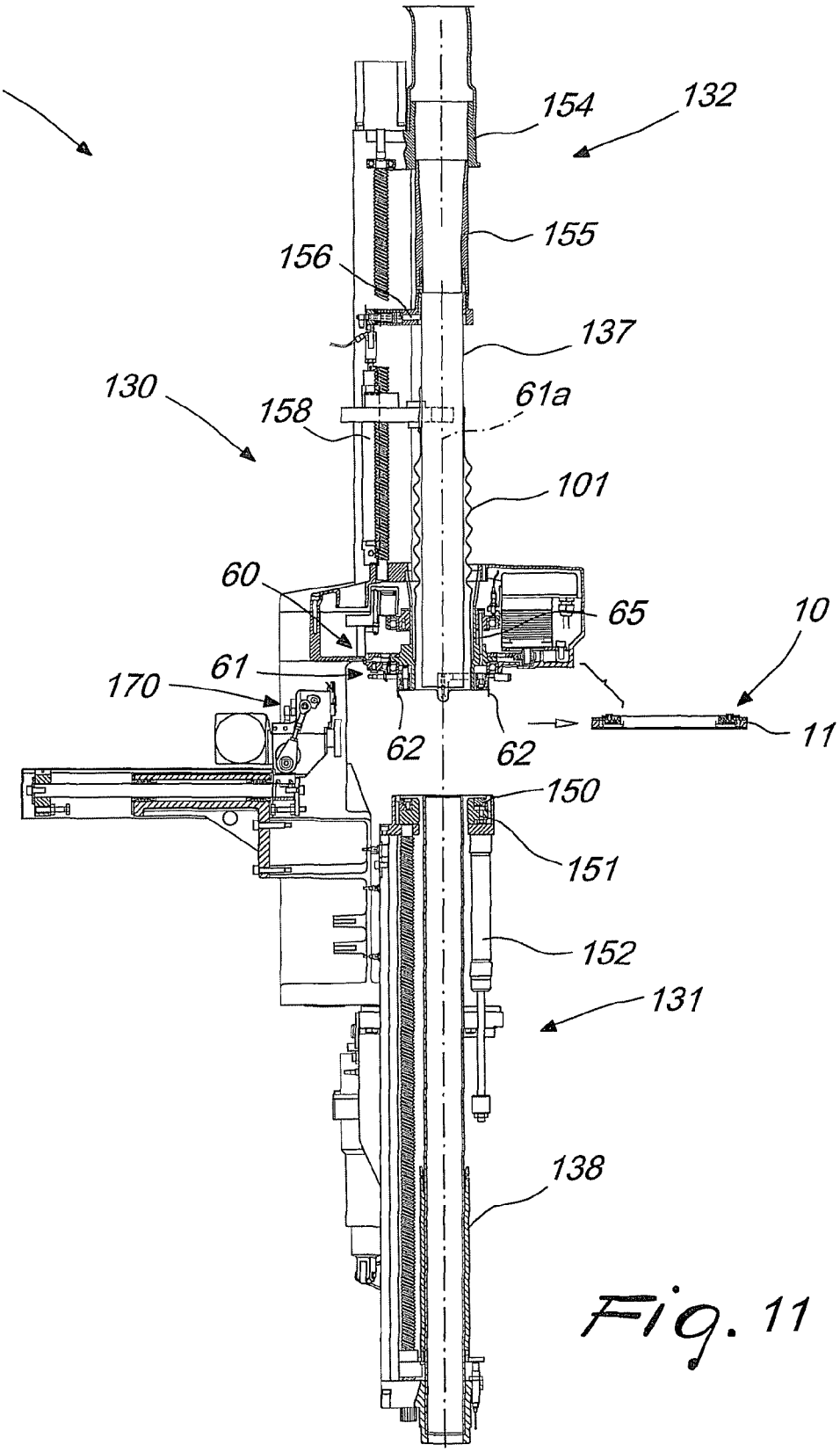

Once the turning of the article 101, which is inside out, has been completed, the movable upper sleeve 155 is lowered by means of the fluid-actuated cylinder 158 until its lower end fits around the protruding edge of the upper axial end of the tubular body 137. Subsequently, the fluid-actuated cylinder 157 is activated and, by means of the movable pin 156, engages the tubular body 137 proximate to its upper axial end. Subsequently, the fluid-actuated cylinder 152 is activated so as to return the annular body 151 into the annular seat 150 and the electric motor 142 is actuated so as to cause the complete lowering of the lower sleeve 138 along the lower guiding cylinder 136. At this point, the body 11 of the pick-up device 10 is moved away from the sewing or looping station 102 and returned to the intermediate position between the sewing or looping station 102 and the machine 100 by way of a lowering caused by the actuation of the electric motor 27 and by means of a rotation about the axis 13*a* caused by the actuation of the electric motor 20 (FIG. 11).

By turning toward the intermediate position, the arm 12 engages by means of its slot 53 the lower end of the pin 51 and, when it reaches the intermediate position, the pin 51 is aligned with the seat 52 at the closed end of the slot 53. For this reason, a further rotation of the arm 12 about the axis 13*a* toward the machine 100 causes the entrainment, jointly in rotation about the axis 13*a*, also of the arm 43 and therefore of the presser 42.

Figure 12:
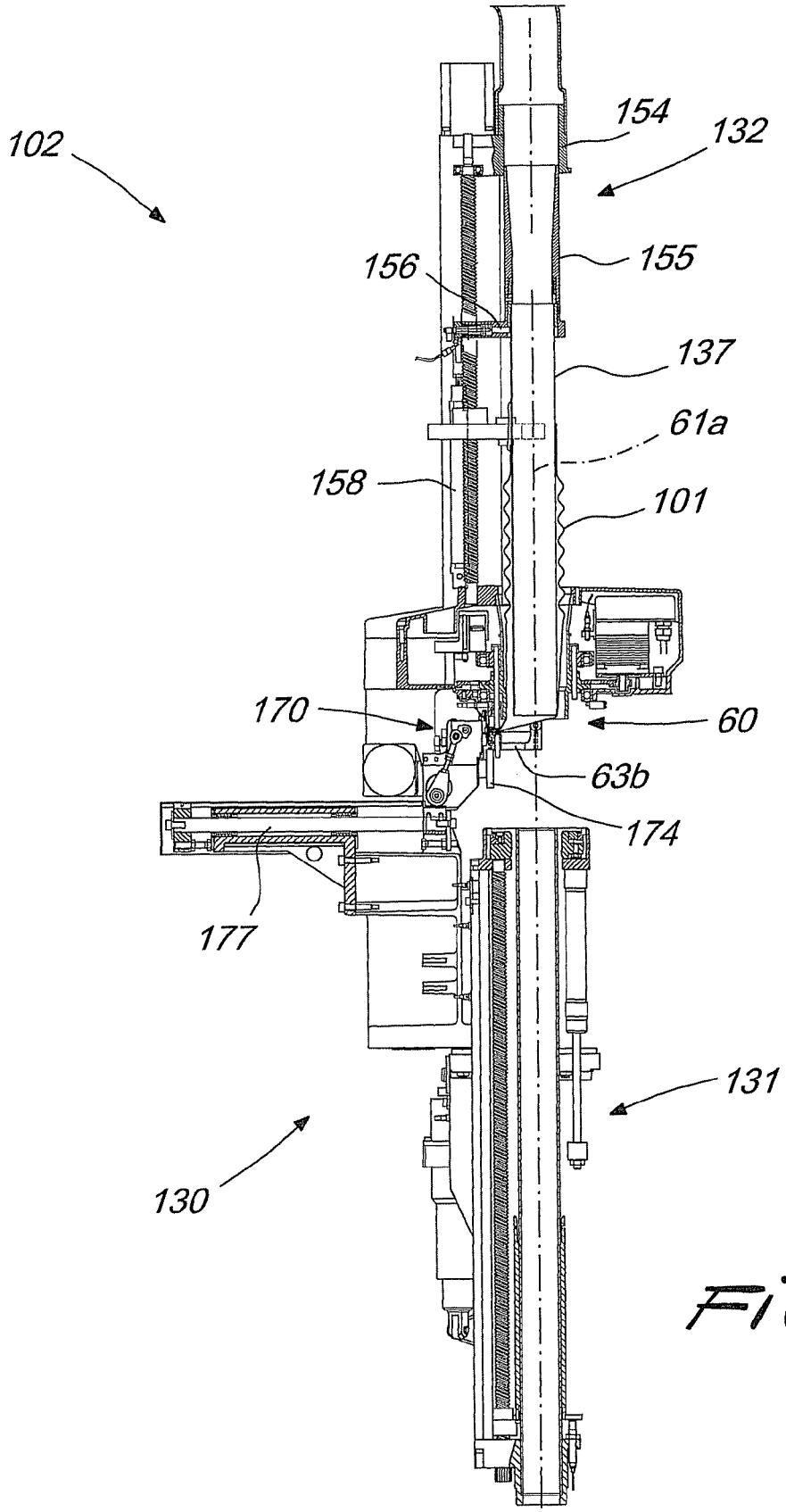
FIG. 12 is a schematic sectional view, similar to FIG. 6, of the step for superimposing each of the loops of knitting of a half-row of knitting on a corresponding loop of knitting of the other half-row of the last row of knitting of the article on a same spike of the handling device by overturning, through an arc of substantially 180°, one of the two semiannular elements that compose the body of the handling device with respect to the other semiannular element, and of the step for sewing or looping the pairs of mutually superimposed loops of knitting.
Figure 12A:
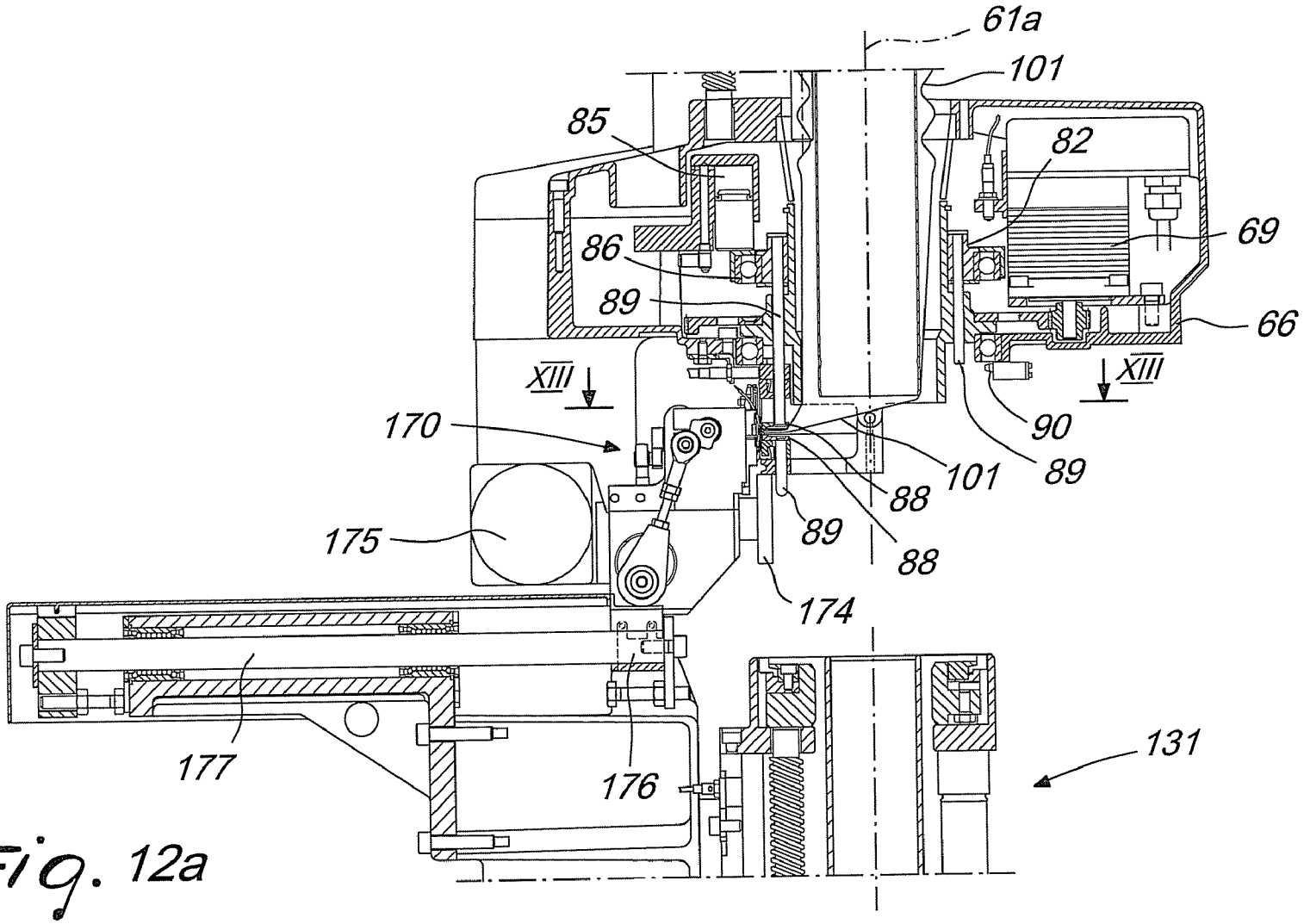
FIG. 12*a* is an enlarged-scale view of a detail of FIG. 12.

The semiannular element 63*b* is then turned over, by way of the actuation of the fluid-actuated cylinder 70, about the diametrical axis 64 below the semiannular element 63*a* so that each one of the spikes 62 of the semiannular element 63*b* is aligned below a spike 62 of the semiannular element 63*a*, as shown in FIG. 31. After the overturning of the semiannular element 63*b*, the sewing or looping head 170 is moved toward the semiannular element 63*b* so as to support in a downward region, by means of the bearing 174, the semiannular element 63*b*. By way of the actuation of the fluid-actuated cylinder 85, the annular actuation body 82 is lowered and causes the lowering of the half of the annular contact body 88 arranged in the semiannular element 63*a*, which transfers the loops of knitting from the spikes 62 of the semiannular element 63*a* to the spikes 62 of the semiannular element 63*b*. In this manner, each spike 62 of the semiannular element 63*b* supports a pair of loops of knitting (FIGS. 12 and 12*a*).

Figure 13:
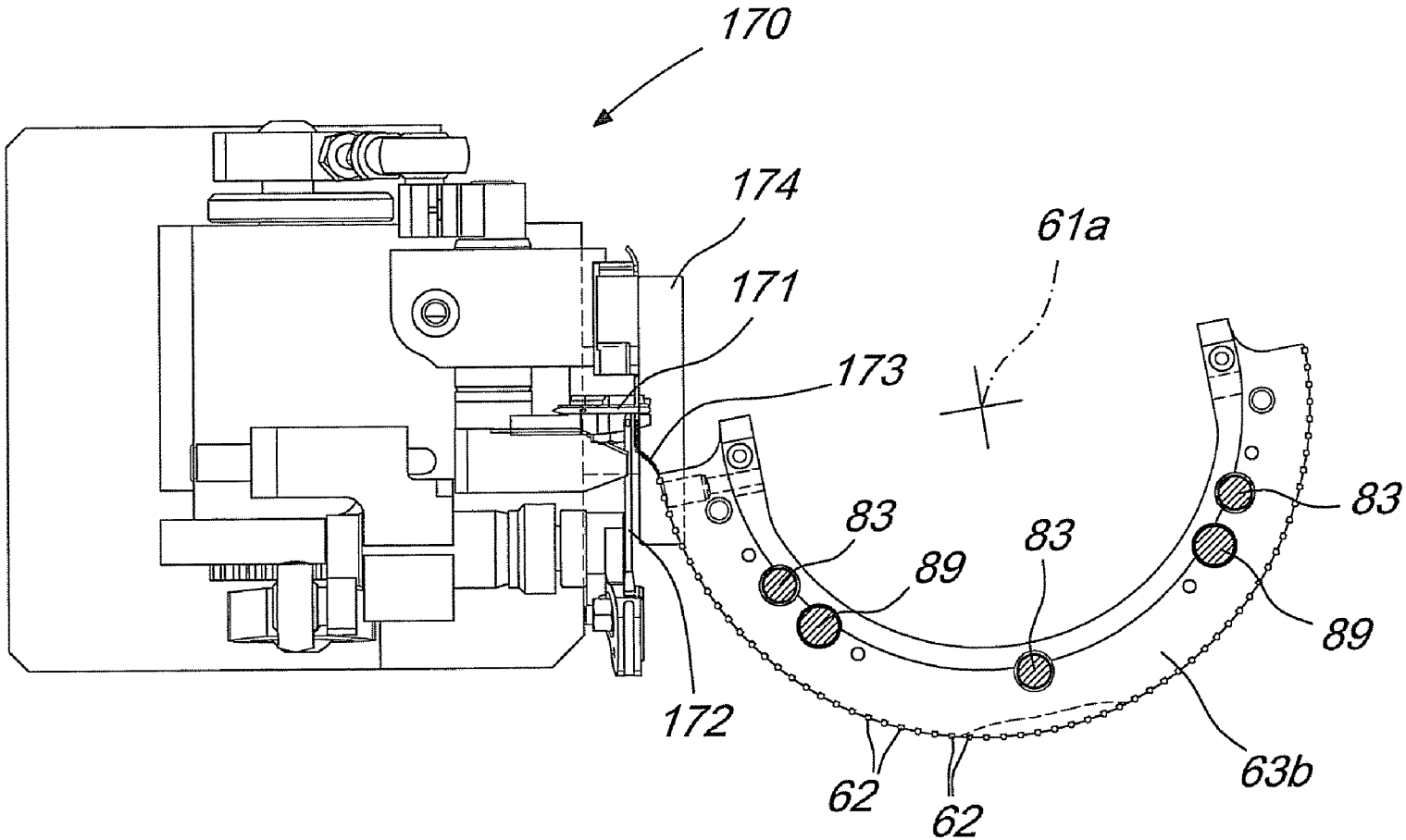
FIG. 13 is a schematic sectional view of FIG. 12*a*, taken along a plane passing through line XIII-XIII, with some elements omitted for the sake of simplicity and greater clarity.

At this point the motor 175 that drives the sewing members of the sewing or looping head 170 and the electric motor 69 are actuated in a mutually synchronized manner so that the semiannular element 63*b* is rotated about the axis 61*a* and so that during this rotation the needle 171 of the sewing head 170 interacts in each instance with a spike 62 of the semiannular element 63*b*, joining the pairs of loops of knitting arranged on a same spike 62. In this manner, the axial end of the tubular article 101 is closed in the inside out configuration (FIG. 13).

Figure 14:
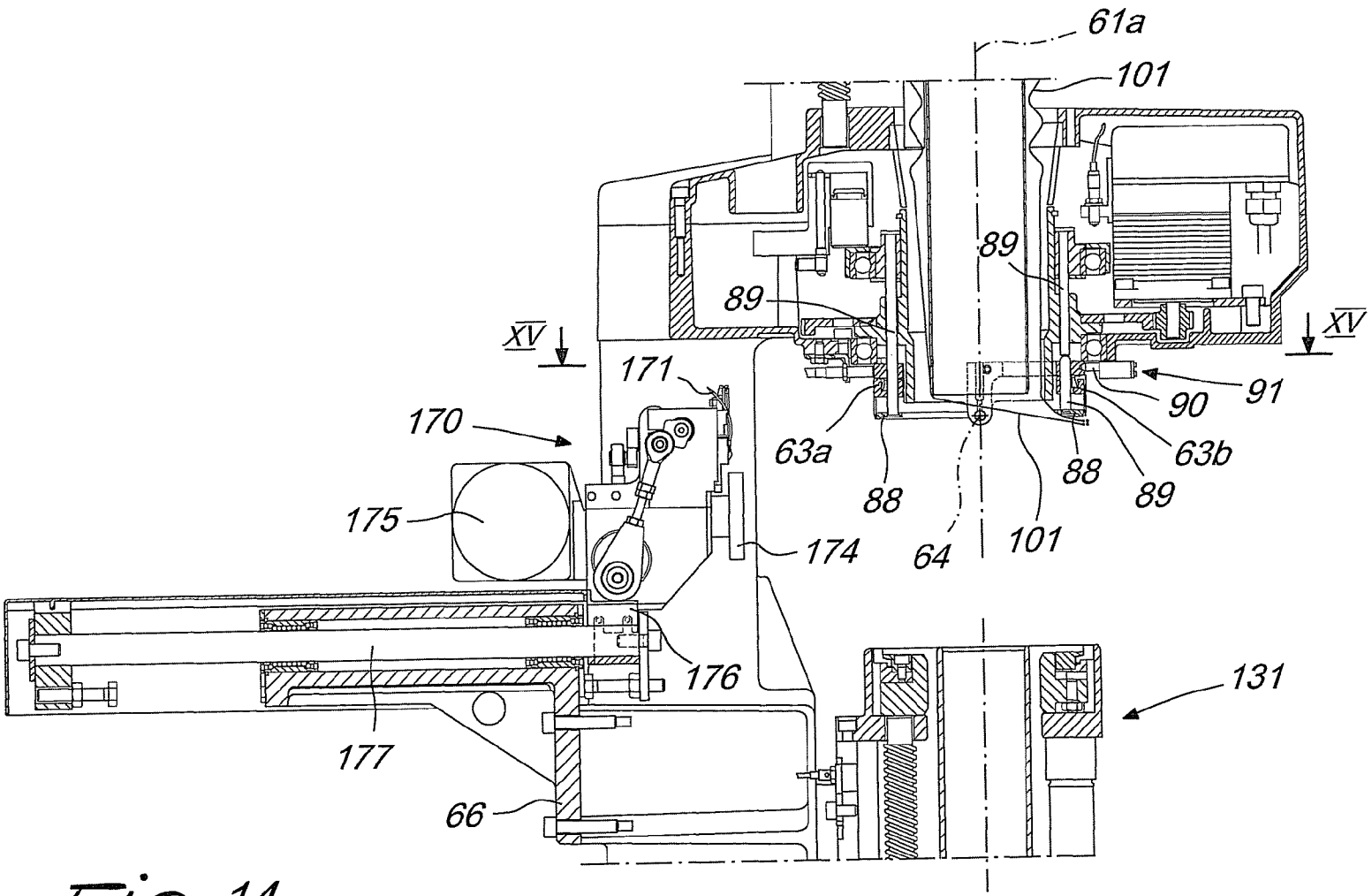
FIG. 14 is a sectional view, similar to FIG. 12*a*, of the step for disengaging the article from the handling device.
Figure 15:
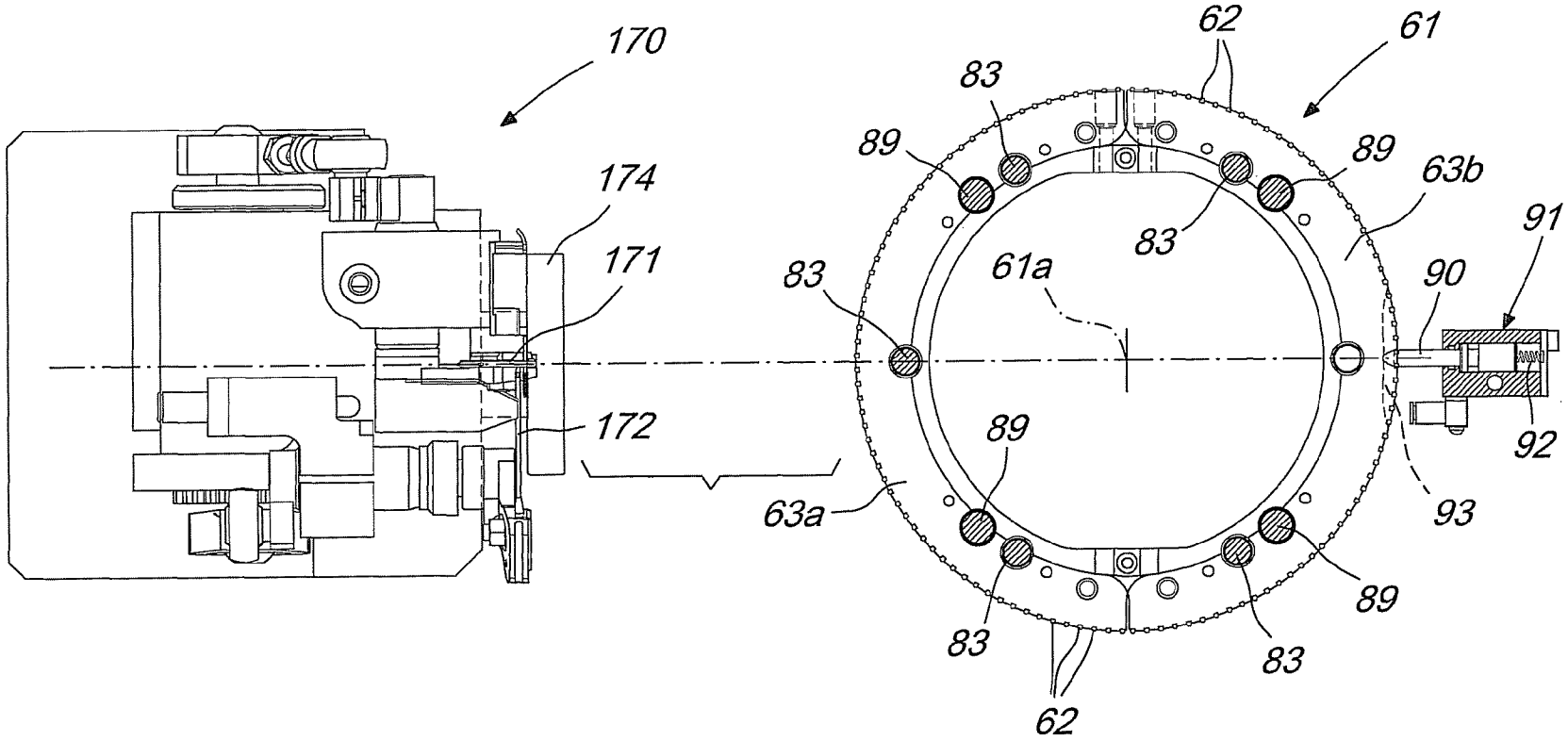
FIG. 15 is a schematic sectional view of FIG. 14, taken along a plane passing through line XV-XV, with some elements omitted for the sake of simplicity and greater clarity.

At the end of the sewing or looping, the sewing or looping chain stitch 173 is cut, and the sewing or looping head 170 is moved away from the semiannular element 63*b*. This semiannular element, after being returned to the rotational position about the axis 61*a* that it occupied before the sewing or looping operation began, and after lifting the annular contact body 88, is turned over about the diametrical axis 64, by means of a new intervention of the fluid-actuated cylinder 70 in the opposite direction with respect to the preceding one, and returned to a position that is coplanar to the semiannular element 63*a* in which it is locked by the pin 90. At this point, the annular contact body 88 is lowered again and causes the disengagement of the article 101 from the spikes 62 of the semiannular element 63*b* (FIGS. 14 and 15).

The article 101, by way of the suction generated in the meantime by the connection of the fixed upper sleeve 154 to suction means, is aspirated into the tubular body 137.

The suction of the article 101, starting from its end that has just been closed, through the lower axial end of the tubular body 137, turns the article 101, which is thus returned to the right-side-out configuration.

Figure 16:
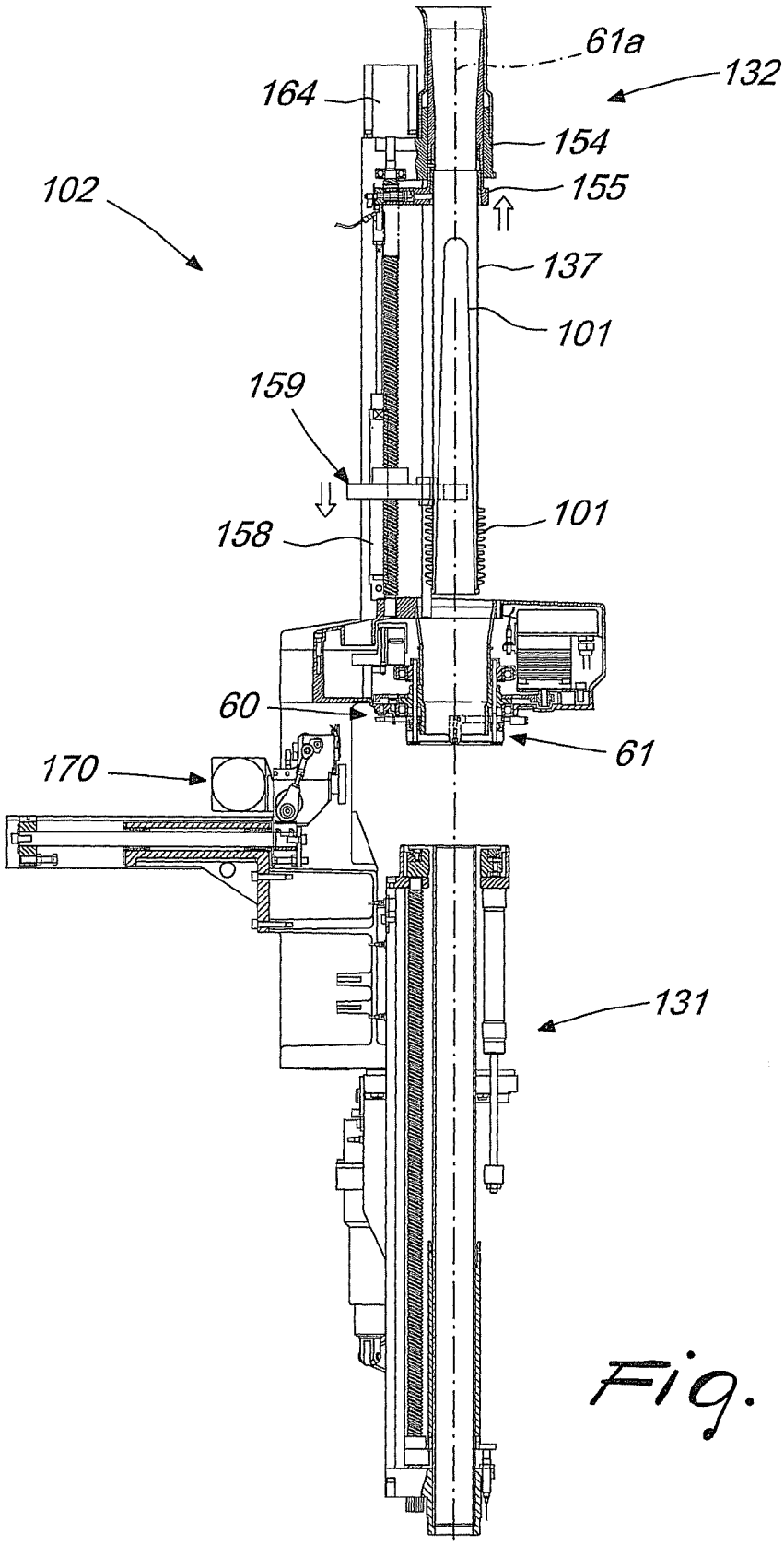
FIG. 16 is a schematic sectional view, similar to FIG. 6, of the step for moving the article away from the apparatus.

Suction of the article 101 into the tubular body 137, through its lower axial end, can be conveniently assisted by the actuation of the auxiliary sliding means 159, which push the article 101 toward the lower axial end of the tubular body 137, which again to facilitate this suction of the article 101 in said tubular body 137 can be raised further, by lifting the movable upper sleeve 155 activated by the fluid-actuated cylinder 158, until its lower axial end lies above the hollow cylinder 65 (FIG. 16).

It should be noted that if the article 101, after being turned inside out, to be brought in the overturned configuration, does not need to be turned again to be returned to the right side out configuration, it is possible to actuate the suction of to the article 101 through the lower axial end of the tubular body 137, starting from the open axial end of the article 101, i.e., from its upper axial end. This can be achieved by pushing the article 101 below the lower axial end of the tubular body 137, by way of the auxiliary sliding means 159, while the tubular body 137 is moved, by way of the lifting of the movable upper sleeve 155, to the further is raised position, shown in FIG. 16, before connecting the interior of the tubular body 137 to the suction means.

Figure 17:
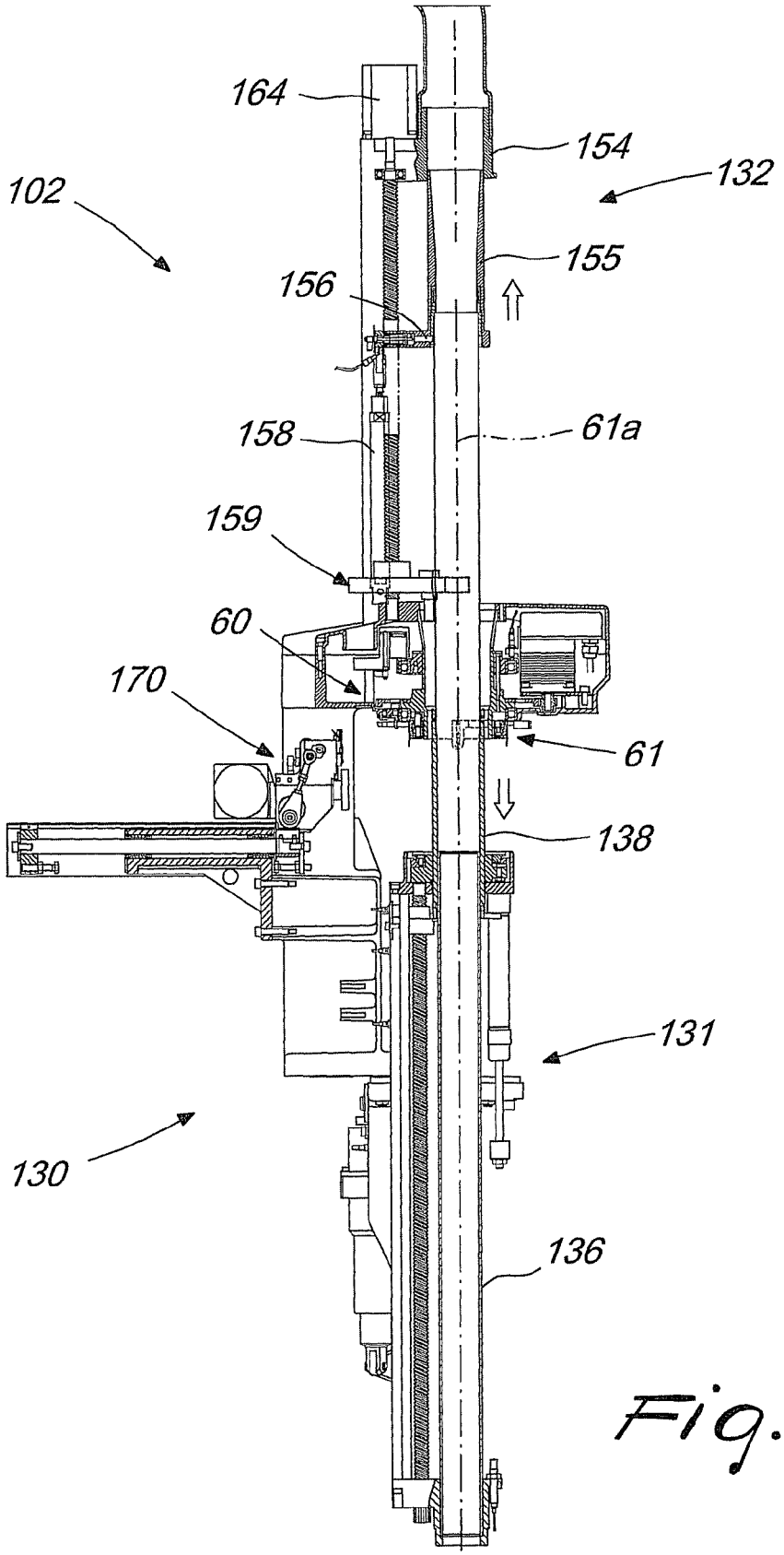
FIG. 17 is a schematic sectional view, similar to FIG. 6, of the return of the apparatus to the condition shown in FIG. 6.
Figure 18:
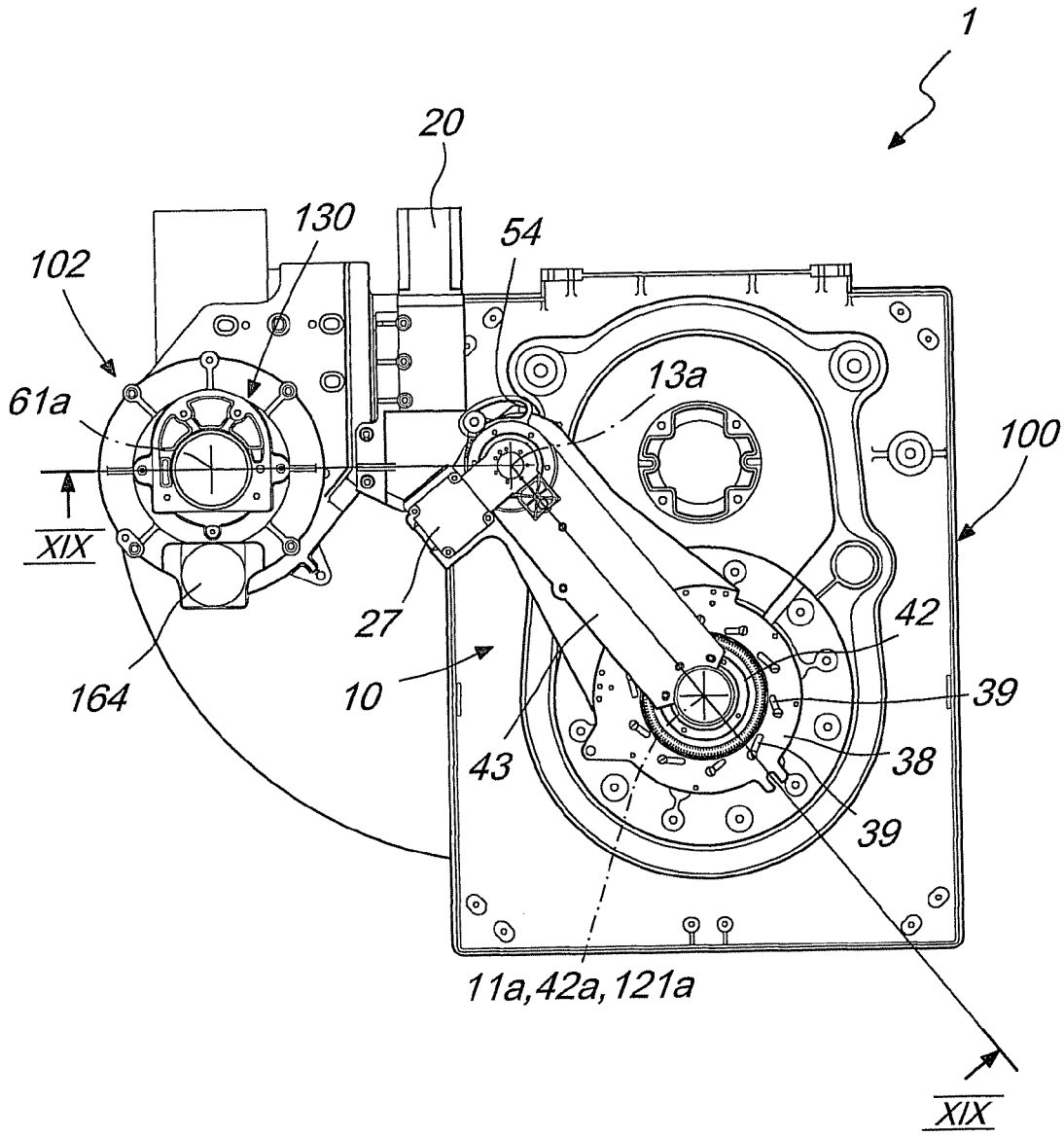
FIG. 18 is a schematic top plan view of the apparatus according to the invention.

After the article 101 has been moved away from the apparatus, the movable upper sleeve 155 is lowered and the lower sleeve 138 is raised, so that the lower axial end of the tubular body 137 enters the lower sleeve 138 (FIG. 17). The movable pin 156 is then disengaged from the protruding edge of the upper axial end of the tubular body 137, which by way of the descent of the lower sleeve 138 is returned to the lowered position around the lower guiding cylinder 136. The movable upper sleeve 155 is raised so as to return the apparatus to the condition shown in FIG. 6, ready to receive a new article 101 to be closed at one of its axial ends.

In practice it has been found that the method and the apparatus for performing it fully achieve the intended aim, since they allow to perform, automatically and with high precision, the closure of tubular articles, particularly hosiery, without penalizing significantly the productivity of the machine used to produce the article and therefore in an economically convenient manner. The particular manner of pick-up of the article from the machine that produces it, with the method according to the invention, ensures high precision during this operation without requiring particularly complicated elements.

Although the method and the apparatus for performing it have been described with reference to their preferred application to a single-cylinder circular machine, they can also be adopted for double-cylinder circular machines to perform the pick-up from the needles, arranged in the lower needle cylinder, of the article at the end of its production.

The method and the apparatus thus conceived are susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application no. MI2008A000397, from which this application claims priority, are incorporated herein by reference.

The invention claimed is:

1. A method for closing a tubular knitted article at one of its axial ends, at an end of a production cycle on a circular knitting machine for a knitted article, comprising an initial step for producing the article up to the formation of the last row of knitting, at the axial end of the article that lies opposite the axial end at which knitting began, by retaining the loops of knitting of said last row of knitting in the head of the needles of the machine that formed them, further comprising the following additional operating steps:

a grip step for individually picking up the loops of knitting by extracting said needles, with one of their portions starting from the head, from the needle cylinder in which they are accommodated, keeping the loops of knitting of the last row of knitting in the head of the needles;

arranging coaxially to the needle cylinder, around the region occupied by the portion of said needles that is extracted from the needle cylinder, the annular body of a pick-up device provided with pick-up members arranged radially to the axis of said body of the pick-up device, each provided with an end directed toward the axis of said pick-up device that can engage the stem of a needles in a region that is proximate to the latch of the needle on the opposite side with respect to the head;

engaging each of said pick-up members with the stem of the corresponding needle;

moving the loop of knitting, previously retained in the head of the corresponding needle along the stem of the needle, until it is brought beyond the corresponding latch and engaged with the pick-up member in engagement against the stem of the corresponding needle;

a step for removing the article from the machine that produced it, retaining each loop of knitting of the last formed row of knitting by means of said pick-up members;

a step for positioning the article at a sewing or looping station;

a step for the individual passage of the loops of knitting from said pick-up members to spikes of an annular handling device composed of two semiannular elements, one of which can be overturned with respect to the other about a diametrical axis;

a step for turning the article retained by said handling device;

a step for superimposing each of the loops of knitting of one half-row of knitting on a corresponding loop of knitting of the other half-row of said last row of knitting on a same spike of said handling device by means of the overturning, through an arc of substantially 180° about said diametrical axis, of one of said two semiannular elements of the handling device with respect to the other semiannular element;

a step for sewing or looping the mutually superimposed pairs of loops of knitting;

a step for disengaging the article from said handling device.

2. The method according to claim 1, during said grip step each pick-up member is engaged with the stem of the corresponding needle between the free end of the open latch of the corresponding needle and the stem of said needle.

3. The method according to claim 1, wherein said removal step consists in producing the axial translational motion of the pick-up device with the loops of knitting of said last row of knitting engaged by said pick-up members, with respect to the needles toward the heads of the needles so as to move beyond the heads of the needles.

4. The method according to claim 1, wherein said turning step consists in:

aspirating the article, starting from its axial end that lies opposite the end engaged with said spikes of the handling device, in a tubular body;

arranging said tubular body coaxially to said handling device;

producing the axial translational motion of said tubular body, making it pass through said handling device engaged by means of its spikes with the loops of knitting of said last row of knitting, everting the article onto the outer lateral surface of said tubular body.

5. The method according to claim 1, wherein said initial step of the production of the article, up to the formation of the last row of knitting, is performed by means of a circular single-cylinder knitting machine for hosiery and the like, and in that in said grip step the needles are extracted with one of their portions starting from the head above the sinkers of the machine; said body of the pick-up device being arranged between the sinkers and the heads of the needles.

6. An apparatus for closing a tubular knitted article at one of its axial ends, at an end of a production cycle on a circular knitting machine for said tubular knitted article, comprising:

a pick-up device , which is provided with an annular body that supports pick-up members that can engage the needles of the machine and are adapted to pick up individually the loops of knitting retained on said needles; said pick-up device being movable on command from a pick-up position, in which it is arranged with its body coaxially around the needle cylinder of the machine , to a release position, in which it is arranged with its body at a sewing or looping station that is spaced laterally with respect to the machine;

a handling device , which is arranged at said sewing or looping station and is provided with an annular body composed of two semiannular elements with spikes that are arranged along a cylindrical surface whose axis coincides with the axis of the body of the handling device and are oriented axially; one of said two semiannular elements being able to turn over with respect to the other semiannular element about a diametrical axis in order to arrange face to face and align individually its spikes with the spikes of the other semiannular element in order to allow the passage of the loops of knitting from the spikes of one semiannular element to the spikes of the other semiannular element of the body of the handling device;

a turner for said tubular knitted articles which is arranged at said sewing or looping station and can be actuated in order to turn a tubular article that is retained, at one of its axial ends, by the spikes of said handling device;

a sewing or looping head, which is arranged at said looping station and is provided with sewing or looping members that interact with the spikes of a semiannular element of the body of said handling device in order to close the axial end of the article by joining the pairs of loops of knitting carried by a same spike of said semiannular element of the body of the handling device;

wherein said pick-up members can move radially with respect to the axis of the body of said pick-up device and, when said pick-up device is in said pick-up position, can each be engaged against the region of the stem of a needle of the machine, said region of the stem of the needle being located proximate to the latch on the opposite side with respect to the head; said pick-up members, when said pick-up device is in said release position, being each engageable with a spike of said handling device .

7. The apparatus according to claim 6, wherein said body of the pick-up device is oriented with its axis vertically and is mounted on an arm that can rotate on command, with respect to a supporting structure , about a vertical actuation axis that is spaced from the axis of said body of the pick-up device for the passage of the pick-up device from said pick-up position to said release position or vice versa.

8. The apparatus according to claim 7, wherein said arm can move on command along said vertical actuation axis.

9. The apparatus according to claim 6, wherein said body of the pick-up device has a plurality of radial slots, each of which accommodates slidingly a pick-up member, said body of the pick-up device supporting radial pushers that act on command on said pick-up members for their sliding away from the axis of said body of the pick-up device in contrast with the action of elastic means; means for delimiting the stroke of said pick-up members toward the axis of said body of the pick-up device being provided.

10. The apparatus according to claim 6, wherein said pick-up device comprises a presser that has a circular plan shape with a comb-like perimetric profile; said presser being arrangeable so as to face coaxially said body of said pick-up device and being movable axially with respect to said body of the pick-up device in order to penetrate with teeth of its peripheral profile between said pick-up members.

11. The apparatus according to claim 6 , wherein an end of each one of said pick-up members that is directed toward the axis of said annular body of the pick-up device has a seat that can be coupled with a stem of the corresponding needle of the machine, with said pick-up device in said pick-up position, or with one of said spikes of the handling device, with said pick-up device in said release position.

12. The apparatus according to claim 11, wherein the end of said pick-up members that is directed toward the axis of said pick-up body can engage, by means of said seat , the stem of the needle between the free end of the open latch of a needle and the stem of said needle.

13. The apparatus according to claim 6, further comprising first axial pusher means that interact with said pick-up members of the pick-up device in said sewing or looping station and with said spikes of the handling device in order to produce the individual passage of the loops of knitting from said pick-up members to said spikes of the handling device.

14. The apparatus according to claim 13, further comprising second axial pusher means that interact with the spikes of said handling device in order to actuate the passage of the loops of knitting from the spikes of one semiannular element to the spikes, which face said spikes, of the other overturned semiannular element or to disengage the loops of knitting from the spikes of said handling device.

15. The apparatus according to claim 11, wherein the end of each one of said pick-up members that is directed toward the axis of said annular body of the pick-up device is shaped like a hook that is open upwardly; said presser being arranged above said body of the pick-up device.

16. The apparatus according to claim 6, wherein said turner comprises a lower portion and an upper portion, which can be arranged coaxially to each other along a vertical main axis at said sewing or looping station; the body of said handling device being arranged so that its axis coincides with said vertical main axis between said lower portion and said upper portion of said turner.

17. The apparatus according to claim 16, wherein said lower portion of the turner comprises lower supporting means for a tubular body with its axis arranged at said vertical main axis and lower means for actuating said tubular body along said vertical main axis in order to make said tubular body pass through said body of the handling device starting from a lowered position, in which said tubular body faces, with its upper axial end, said body of the handling device in a downward region, to a raised position in which it is arranged with its lower axial end proximate to said body of the handling device and vice versa.

18. The apparatus according to claim 17, wherein said upper portion of the turner comprises upper supporting means that can engage the upper axial end of said tubular body and upper actuation means of said tubular body for actuating its lifting along said main axis from said raised position to a further raised position, in which its lower axial end is spaced upwardly with respect to said body of the handling device and vice versa.

19. The apparatus according to claim 18, wherein said lower supporting means and said upper supporting means are adapted to connect the inside of said tubular body to pneumatic suction means.

20. The apparatus according to claim 19, wherein said upper portion of the turner comprises auxiliary sliding means, which face the outer lateral surface of said tubular body and can move on command with respect to said tubular body parallel to said vertical main axis; said auxiliary sliding means being cyclically engageable and disengageable with respect to the article everted onto the outer lateral surface of said tubular body in order to actuate its sliding toward the lower axial end of said tubular body.

21. An apparatus, according to claim 17, wherein said lower portion of the turner can be tilted on command with respect to said vertical main axis in order to move the upper axial end of said tubular body, in said lowered position, toward the machine used to produce the article.

22. A method for closing a tubular knitted article at one of its axial ends, at an end of a production cycle on a circular knitting machine for a knitted article, comprising an initial step for producing the article up to the formation of the last row of knitting, at the axial end of the article that lies opposite the axial end at which knitting began, by retaining the loops of knitting of said last row of knitting in the head of the needles of the machine that formed them, further comprising the following additional operating steps:

a step for individually picking up the loops of knitting by virtue of pick-up members arranged against the region of the stem of each needle located proximate to the latch on the opposite side with respect to the head each pick up member being engaged with the stem of the corresponding needle between a free end of an open latch of the corresponding needle and the stem of the needle corresponding;

a step for removing the article from the machine that produced it, retaining each loop of knitting of the last formed row of knitting by means of said pick-up members;

a step for positioning the article at a sewing or looping station;

a step for the individual passage of the loops of knitting from said pick-up members to spikes of an annular handling device composed of two semiannular elements, one of which can be overturned with respect to the other about a diametrical axis;

a step for turning the article retained by said handling device;

a step for superimposing each of the loops of knitting of one half-row of knitting on a corresponding loop of knitting of the other half-row of said last row of knitting on a same spike of said handling device by means of the overturning, through an arc of substantially 180° about said diametrical axis, of one of said two semiannular elements of the handling device with respect to the other semiannular element;

a step for sewing or looping the mutually superimposed pairs of loops of knitting;

a step for disengaging the article from said handling device.

* * * * *